US012018855B2

(12) United States Patent
Inagaki et al.

(10) Patent No.: US 12,018,855 B2
(45) Date of Patent: Jun. 25, 2024

(54) AIR CONDITIONER

(71) Applicant: FUJITSU GENERAL LIMITED, Kanagawa (JP)

(72) Inventors: Eri Inagaki, Kanagawa (JP); Shingo Nishioka, Kanagawa (JP)

(73) Assignee: FUJITSU GENERAL LIMITED, Kanagawa (JP)

( * ) Notice: Subject to any disclaimer, the term of this patent is extended or adjusted under 35 U.S.C. 154(b) by 661 days.

(21) Appl. No.: 17/267,411

(22) PCT Filed: Mar. 20, 2019

(86) PCT No.: PCT/JP2019/011718

§ 371 (c)(1),
(2) Date: Feb. 9, 2021

(87) PCT Pub. No.: WO2020/039634

PCT Pub. Date: Feb. 27, 2020

(65) Prior Publication Data

US 2021/0293443 A1 Sep. 23, 2021

(30) Foreign Application Priority Data

Aug. 24, 2018 (JP) ..... 2018-157750

(51) Int. Cl.

| | |
|---|---|
| ***F24F 13/06*** | (2006.01) |
| ***F24F 13/20*** | (2006.01) |
| ***F24F 13/22*** | (2006.01) |

(52) U.S. Cl.

CPC ..... *F24F 13/06* (2013.01); *F24F 13/20* (2013.01); *F24F 13/22* (2013.01); *F24F 13/222* (2013.01); *F24F 2013/0616* (2013.01); *F24F 2221/14* (2013.01); *F24F 2221/26* (2013.01)

(58) Field of Classification Search

CPC .. F24F 13/06; F24F 13/20; F24F 13/22; F24F 13/222; F24F 1/0057; F24F 2013/0616; F24F 2221/14; F24F 2221/26

USPC ..... 454/292

See application file for complete search history.

(56) References Cited

U.S. PATENT DOCUMENTS

| | | | | |
|---|---|---|---|---|
| 9,897,335 | B2 * | 2/2018 | Nouchi | F24F 1/0047 |
| 11,767,989 | B2 * | 9/2023 | Fujioka | F24F 1/0011 62/285 |
| 2021/0140676 | A1 * | 5/2021 | Meng | F24F 1/0011 |

* cited by examiner

*Primary Examiner* — Allen R. B. Schult

(74) *Attorney, Agent, or Firm* — Paratus Law Group, PLLC

(57) ABSTRACT

[Problem] To provide an air conditioner provided with a water dripping prevention means which does not visually stand out, but rather improves outer appearance quality. [Solution] A dotted embossed pattern including a plurality of projections is formed along a panel opening forming an air outlet in a decorative panel. The projections have gaps (preferably 2.0 mm) therebetween such that condensation generated on a panel surface of the decorative panel can flow along the panel surface.

15 Claims, 36 Drawing Sheets

(a)

(b)

(a)

(b)

(a)

(b)

(a)

(b)

(a)

(b)

(a)

(b)

(a)

(b)

AIR CONDITIONER

CROSS REFERENCE TO PRIOR APPLICATION

This application is a National Stage Patent Application of PCT International Patent Application No. PCT/JP2019/011718 (filed on Mar. 20, 2019) under 35 U.S.C. § 371, which claims priority to Japanese Patent Application No. 2018-157750 (filed on Aug. 24, 2018), which are all hereby incorporated by reference in their entirety.

TECHNICAL FIELD

The present invention relates to an air conditioner, and in particular relates to technology in a ceiling-embedded air conditioner for preventing water dripping due to dew condensation at an air blowing port during cooling operation.

BACKGROUND ART

In a ceiling-embedded air conditioner, an outdoor unit installed outdoors and an indoor unit installed in an attic of an air-conditioning room (air-conditioned room) are connected by gas pipes and liquid pipes to form a refrigerant circuit. The indoor unit has a box-type body unit embedded in an attic and a decorative panel disposed on the air-conditioning room side of the ceiling and mounted on the body unit.

As an example, in the invention described in Patent Literature 1, the body unit is provided with a U-shaped heat exchanger, a fan casing in the center of the heat exchanger, and a blower fan formed of a sirocco fan surrounded by the fan casing. The decorative panel is formed with a blowing port at the center and suction ports along three sides below the heat exchanger.

The air drawn in through the suction ports is heat exchanged with refrigerant in the heat exchanger and can then be blown out through the blowing port in one direction. With the heat exchanger surrounding the blower fan, the distance between the blower fan and the surface of the heat exchanger is almost constant so that the airspeed and air volume of the air passing through the heat exchanger are less biased, and the heat exchanger can be used effectively to increase the heat exchange capacity.

CITATION LIST

Patent Literature

Patent Literature 1: Japanese Patent Laid-Open No. 2000-213767

SUMMARY OF INVENTION

Technical Problem

From a blowing port, conditioned air heat-exchanged by a heat exchanger is blown out. However, since cold air is blown out from the blowing port during cooling operation, dew condensation is liable to occur on a panel surface around the blowing port in a decorative panel, which cause dripping of droplets when the dew condensation grows (water dripping).

As one of the technologies to prevent water dripping, forming a plurality of ribs, for example, in parallel along a lower edge of the blowing port is known. However, since the blowing port is a part that is noticeable to users, the outer appearance is compromised, which is not desirable in terms of the design.

It is therefore an object of the present invention to provide an air conditioner provided with a water dripping prevention means, which does not visually stand out in outer appearance, as a technology for preventing water dripping caused by dew condensation at an air blowing port during cooling operation.

Solution to Problem

In order to solve the above-described problem, the present invention is provided with a dotted surface texture including a plurality of projections being formed along a panel opening that forms an air blowing port in a decorative panel, and the above-described projections being disposed at intervals which allows condensation water adhered to a panel surface of the above-described decorative panel to flow along the above-described panel surface.

In the present invention, preferably, recesses between the above-described projections are finished into a mirrored surface, and top surfaces of the above-described projections are rougher surfaces than those of the above-described recesses.

The above-described plurality of projections preferably have a cylindrical shape and are disposed at intervals of 1.0 to 3.0 mm. In addition, the above-described projections preferably have a diameter of 1.0 mm and a height of 50 μm.

The present invention also includes an aspect of a ceiling-embedded air conditioner including:

a box-type body unit disposed in an attic of an air-conditioning room; and a decorative panel mounted on a bottom surface of the above-described body unit along a ceiling surface of the above-described air-conditioning room, the above-described decorative panel provided with an air suction part and an air blowing part, wherein the above-described air blowing part includes a fixed blowing part and truncated conical-shaped rotating units disposed on both sides thereof, and a raised part protruding toward the above-described air-conditioning room side more than a panel surface of the above-described decorative panel, and a cover panel of the fixed blowing part and the above-described rotating units are provided with dotted surface texture including the above-described plurality of projections.

Advantageous Effects of Invention

According to the present invention, an air conditioner provided with a water dripping prevention means which does not visually stand out in outer appearance is provided.

DESCRIPTION OF EMBODIMENTS

Some forms of implementing the present invention will be described in detail below as examples based on the accompanying drawings. The present invention is not limited thereto.

In an air conditioner according to the present invention, an outdoor unit (not illustrated) installed outdoors and an indoor unit 1 mounted on a ceiling T1 of an air-conditioning room R are connected by a gas pipe and a liquid pipe (both not illustrated) to form a refrigerant circuit.

Figure 1:
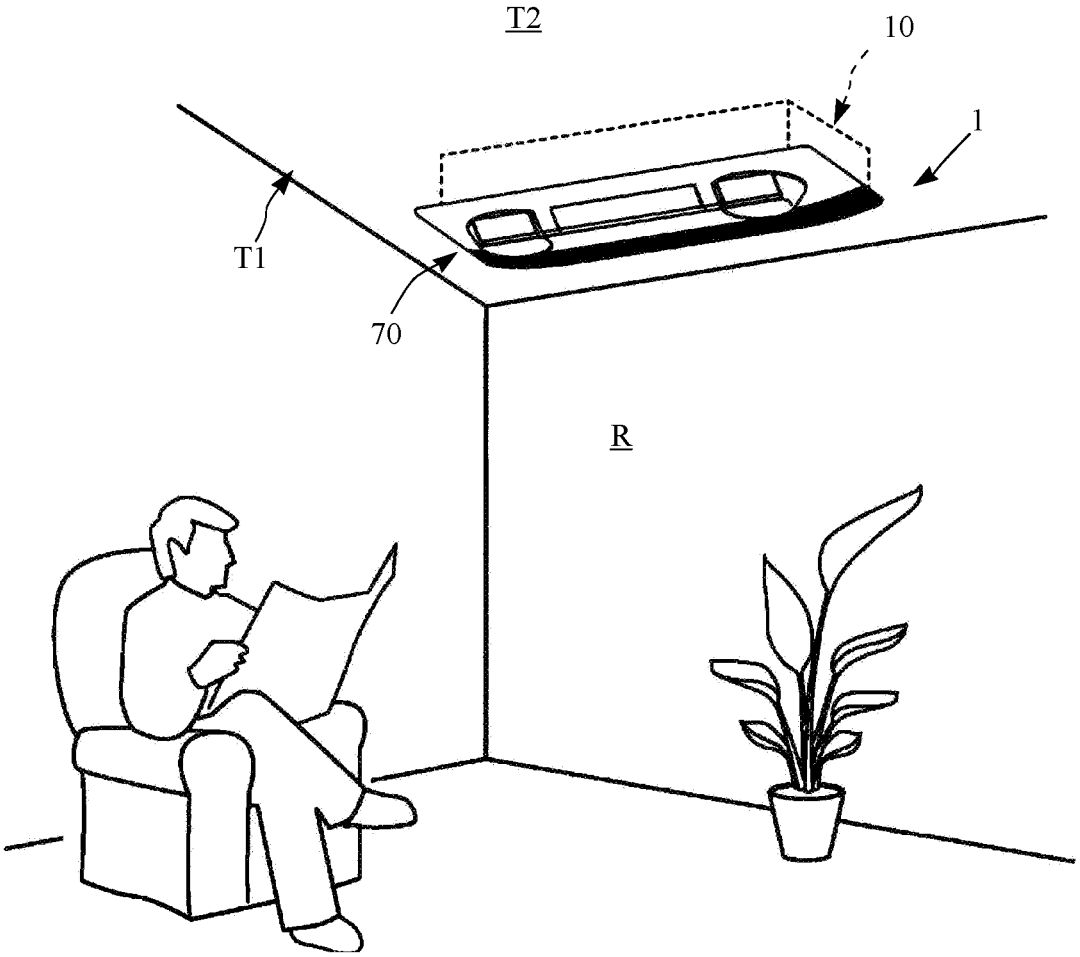
FIG. 1 is an explanatory drawing illustrating a state of installation of a ceiling-embedded air conditioner according to the present invention.
Figure 2:
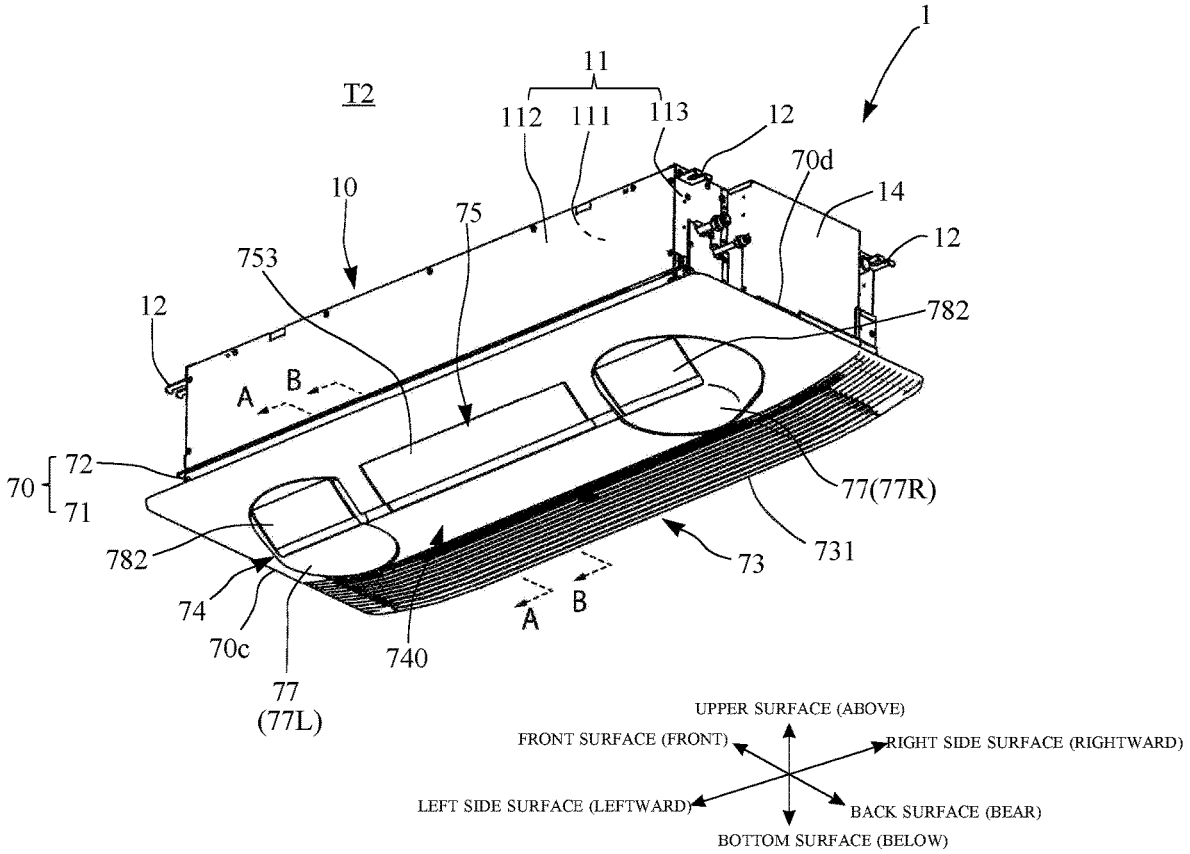
FIG. 2 is a perspective view illustrating the above-described ceiling-embedded air conditioner.
Figure 3:
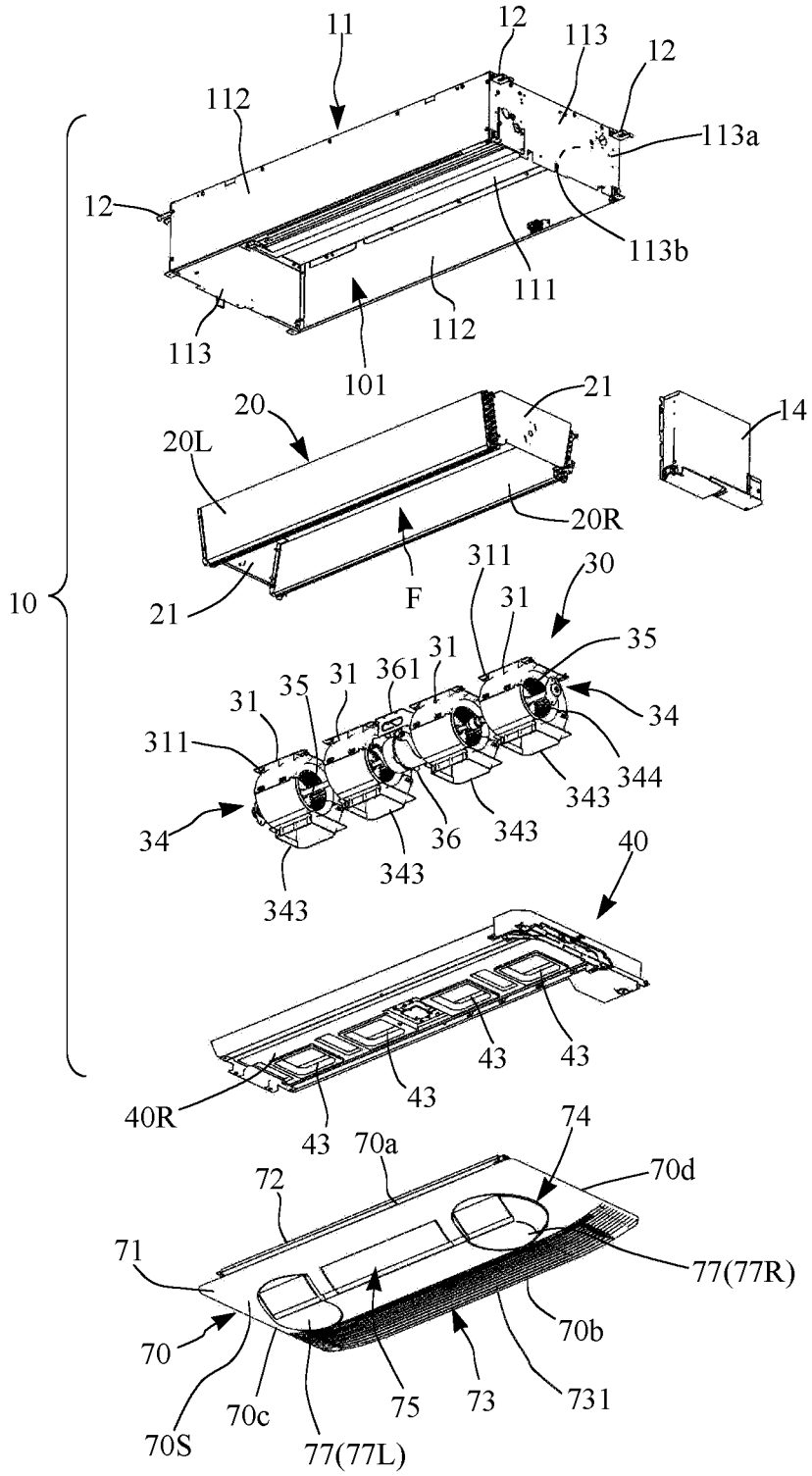
FIG. 3 is an exploded perspective view of the above-described ceiling-embedded air conditioner.

Referring to FIG. 1 to FIG. 3, the indoor unit 1 of the present embodiment is a ceiling-embedded air conditioner having a box-type body unit 10 embedded into an attic T2, and a decorative panel 70 disposed on the air-conditioning room R side of the ceiling T1 and mounted on a bottom surface 101 of the same body unit 10, and in particular, is a ceiling-embedded air conditioner of an omnidirectional blowing type, which blows conditioned air over a wide range.

Referring to FIG. 3, the body unit 10 has a rectangular-shaped top panel 111 formed of sheet metal and a box-type outer body 11 formed from side plates 112, 113 extending downward from four sides of the top panel 111. Two mounting brackets 12 each are secured to two side plates 113 facing each other, with the side plate 112 being the side plate on the long side of the top panel 111 and the side plate 113 being the side plate on the short side of the top panel 111.

The body unit 10 is installed in the attic T2 by suspending the mounting brackets 12 with a plurality of hanging bolts, not illustrated, which are fixed to the attic T2.

The decorative panel 70 has a panel part 71 that forms a main body of the decorative panel 70, which is larger than the top panel 111 and has a rectangular shape, and a side wall portion 72 that is erected from a rear surface 70R of the panel part 71 to the body unit 10 side and is sized to fit, and mounted on, an opened bottom surface of the box-type outer body 11 (the bottom surface 101 of the body unit 10).

The panel part 71 has an air suction part 73 squarely opened on the side of one side 70*b* located at the rear out of the long sides facing each other, and an air blowing part 74 on the side of the other side 70*a* located in front of the long side that faces the one side 70*b*.

Figure 10:
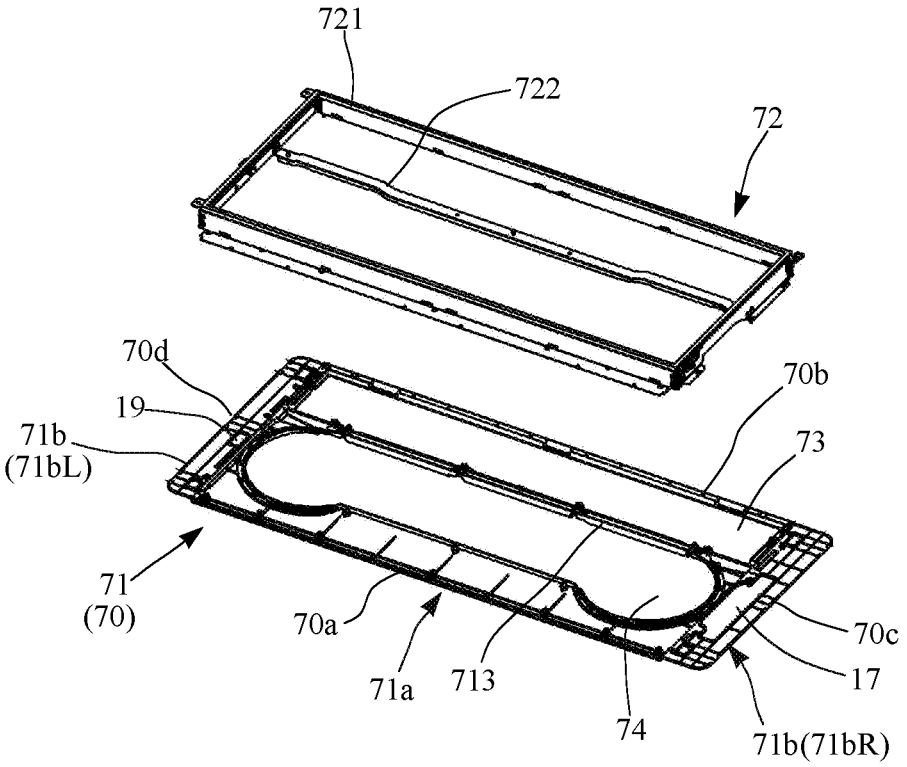
FIG. 10(*a*) is a perspective view illustrating a decorative panel and a frame at a distance from each other, and (b) is a perspective view illustrating a packaged state of the decorative panel.
Figure 10:
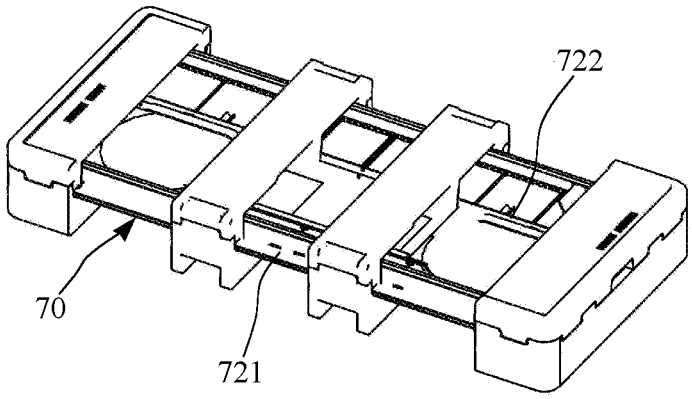

Referring to FIG. 10(*a*), a portion of the panel part 71 where the air suction part 73 and the air blowing part 74 are provided is a panel main body 71*a*, and on both left and right sides of the panel main body 71*a*, the side panel 71*b* is formed integrally. In FIG. 10(*a*), 71*b*R designates the right-side side panel, and 71*b*L designates the left-side side panel.

In the indoor unit 1 in FIG. 2, the direction of the top panel 111 will be described below as upper surface or above, the direction of the air-conditioning room R as bottom surface or below, the side of the air blowing part 74 as front surface or front, the side of the air suction part 73 as back surface side or rear, the side of the left short side 70*c* as left side surface or leftward, and the side of the right short side 70*d* as right side surface or rightward. The same applies to each of the parts.

The side wall portion 72 includes, as illustrated in FIG. 10(*a*), a frame 721 sized to enclose the air suction part 73 and the air blowing part 74 formed in a square shape along each side of the panel part 71 (long sides 70*a*, 70*b*, short sides 70*c*, 70*d*), and a beam 722 bridged between the short sides of the frame 721 (short sides 70*c*, 70*d* of the panel part 71), and is screwed integrally to the rear surface of the panel part 71 (decorative panel 70).

The frame 721 and the beam 722 are both made of sheet metal, and the beam 722 is placed on a partitioning part 713 formed between the air suction part 73 and the air blowing part 74 of the panel part 71.

In this configuration, as illustrated in FIG. 10(*b*), when packing the decorative panel 70, the beam 722 is held down by a protrusion on the packing material side, and can thereby prevent damage due to impact such as when dropped. The beam 722 also provides a structure that can withstand a load applied in a direction parallel to a panel surface 70S of the decorative panel 70.

The beam 722 may be bridged between the long sides 70*a* and 70*b* of the frame 721, depending on the shape and arrangement of the air suction part 73 and the air blowing part 74, or the like.

<Outer Body>

Next, referring to FIG. 3 to FIG. 6, the parts housed in the body unit 10 will be described. The inner surface of the top panel 111 of the outer body 11 is provided with a heat insulating material 13 formed of a polystyrene foam having a thick plate thickness.

A thin heat insulating sheet (not illustrated) is sufficient for the inner surface of the side plates 112, 113 of the outer body 11, instead of the heat insulating material 13. The center of the heat insulating material 13 is open and a part of the top panel 111 is exposed when viewed from below. A heat exchanger 20 and a fan unit 30 are fixed to the exposed part of the top panel 111.

As illustrated in FIG. 2 and FIG. 3, an electrical component box 14 storing electrical components (not illustrated) for controlling the indoor unit 1 is mounted on the outer surface on the right side surface of the outer body 11.

<Heat Exchanger>

Figure 4:
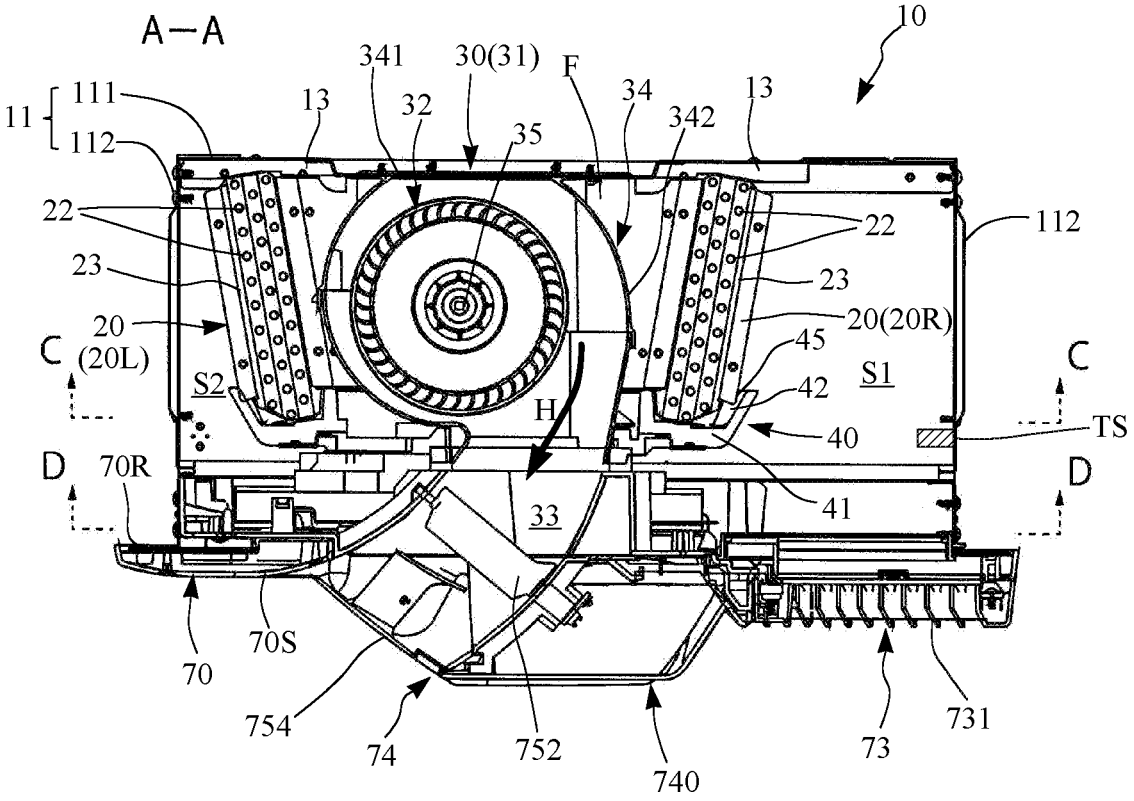
FIG. 4 is a schematic cross-sectional view taken along the A-A line of FIG. 2.
Figure 5:
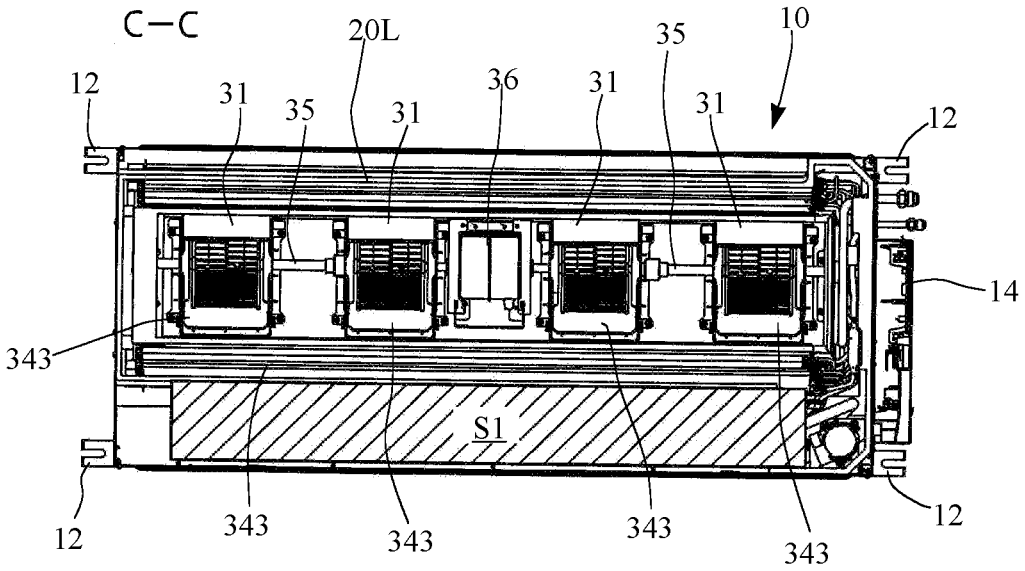
FIG. 5 is a schematic cross-sectional view taken along the C-C line of FIG. 4.

The heat exchanger 20 is of a fin-tube type formed from a plurality of reed-shaped aluminum fins 23 arranged in parallel and a plurality of heat transfer tubes 22 penetrating the aluminum fins 23, and is provided with two heat exchanger sections, or a front heat exchanger section (first heat exchanger section) 20L on the left side in FIG. 4 and a rear heat exchanger section (second heat exchanger section) 20R, on the right side also in FIG. 4 as two heat exchanger sections separated from each other.

The front heat exchanger section 20L and the rear heat exchanger section 20R are mounted on the top panel 111 so as to face each other. The front heat exchanger section 20L and the rear heat exchanger section 20R may be arranged parallel to each other almost perpendicular to the top panel 111, but are preferably assembled so as to slant downwards, in which the spacing (distance) on the upper end side is wider (longer) than the spacing (distance) on the lower end side as illustrated in FIG. 4, in order to keep the height dimensions low and to increase the heat exchange area. Instead of slanting downwards, slanting upwards, in which the spacing (distance) on the upper end side is narrower (shorter) than the spacing on the lower end side, is also applicable.

In any case, both the left and right ends of the front heat exchanger section 20L and the rear heat exchanger section 20R are coupled respectively by coupling plates 21 and 21. In this way, the space inside the heat exchanger 20 functions as a blower chamber F with both the left and right ends blocked by the coupling plates 21, 21. A bottom surface of the heat exchanger 20 (a surface between lower ends of the front heat exchanger section 20L and the rear heat exchanger section 20R) is blocked by a drain pan 40, as described below.

In this manner, since both the left and right ends of the front heat exchanger section 20L and the rear heat exchanger section 20R are blocked by the coupling plates 21, 21, all the air drawn in from the air suction part 73 passes through the front heat exchanger section 20L and the rear heat exchanger section 20R, and thus the heat exchange capacity is further enhanced without wasted air flow.

In the interval between the heat exchanger 20 and the outer body 11, a first air suction chamber S1 is provided between the outer body 11 and the rear heat exchanger section 20R, and a second air suction chamber S2 is provided between the outer body 11 and the front heat exchanger section 20L. The first air suction chamber S1 is disposed directly above the air suction part 73, and the second air suction chamber S2 is communicated with the air suction part 73 via an air conduction path L described below.

<Blower Fan>

The fan unit 30 is located in the blower chamber F provided inside the heat exchanger 20. The fan unit 30 has sirocco fan type blower fans 31, a fan motor 36, a fan mount 311 (see FIG. 3) which supports and fixes the blower fans 31 to the top panel 111, and a motor mount 361 (see FIG. 3) which fixes the fan motor 36 to the top panel 111.

The blower fan 31 includes a tubular impeller (sirocco fan) 32 provided with a plurality of blades, a spiral fan casing 34 housing the impeller 32, and a rotating shaft 35 coupled to the center of the impeller 32.

The number of blower fans 31 is optionally selected according to the required air conditioning capacity, but in the present embodiment, four fans are arranged coaxially side-by-side. The blower fans 31 have the same structure, respectively.

In the fan unit 30, the fan motor 36 is fixed to the top panel 111 by the motor mount 361, and then two each of the blower fans 31 are coupled to each other at both ends of the fan motor 36 by a rotating shaft 35. Both ends of the rotating shaft 35 are fixed to the top panel 111 via bearing plates, not illustrated, for example, made of an L-shaped bracket. There is also a fan fixing section 341 (see FIG. 4) at the upper part of the fan casing 34, which is fixed to the top panel 111 with screws.

The fan casing 34 includes a housing section 342 that houses the impeller 32, and a tubular air-blowing section 343 that is formed continuously from the housing section 342 and extends downward beyond the lower end of the heat exchanger 20. A fan suction port 344 is circularly opened on the side surface of the housing section 342 to draw air into the impeller 32.

The fan casing 34 may be formed by dividing the interior into upper and lower compartments by a plane parallel to the axis of the impeller 32 or may be formed by dividing the interior into left and right compartments by a plane perpendicular to the axis of the impeller 32 so that the impeller 32 can be housed inside. In the interior of the fan casing 34, the housing section 342 and the air-blowing section 343 are continued to form an airflow path 33 for blown air H.

As described above, in the present embodiment, since the fan unit 30 is disposed with the internal space surrounded by the heat exchanger 20 as the blower chamber F, when the impellers 32 of the blower fans 31 rotate, negative pressure is created inside the blower chamber F, and thus the air from the air suction part 73 passes through the front heat exchanger section 20L and the rear heat exchanger section 20R, enters the blower chamber F, is sucked into the fan suction ports 344, and discharged to the peripheries of the impellers 32, and the discharged air is blown out along the airflow paths 33 in the fan casings 34 in one direction and blown out of the air blowing part 74 into the air-conditioning room R.

<Drain Pan>

A drain pan 40 is provided at the lower end of the heat exchanger 20 to receive drained water produced by the heat exchanger 20. The drain pan 40 is molded integrally with an insulating member 41 made of polystyrene foam and a resin-made drain sheet 42 provided on a surface facing the heat exchanger 20.

The drain pan 40 is formed in a rectangular shape having a size that covers the opening surface of the lower end side of the heat exchanger 20 and is also a partitioning plate that partitions the blower chamber F from the air conduction path L described below. The drain pan 40 is provided with ventilation holes 43 through which the tubular air-blowing sections 343 of the fan unit 30 are fitted by the number corresponding to the number of the blower fans 31 (four in the present embodiment).

As described above, as the heat exchanger 20 includes the front heat exchanger section 20L and a rear heat exchanger section 20R arranged so as to slant downwards, and thus the bottom surface is narrower than the upper surface, the drain pan 40 is correspondingly small, and the area occupied by the drain pan 40 in the body unit 10 is small, so that the ventilation resistance by the drain pan 40 is also reduced and the ventilation area around the drain pan 40 is enlarged to enhance the ventilation efficiency.

On the drain sheet 42 side of the drain pan 40, a flume section 45 is provided to receive the drained water produced by the heat exchanger 20. Since the condensation water generated on the outer side of the fan casing 34 during cooling operation can be received by the drain pan 40, it is preferable to provide waterproofing around the ventilation holes 43.

Although not illustrated, the drain pan 40 may be provided with a drain pump and a drain hose for discharging the drained water, as well as a float switch, or the like, for the on-off controlling of the drain pump.

<Decorative Panel>

Figure 11:
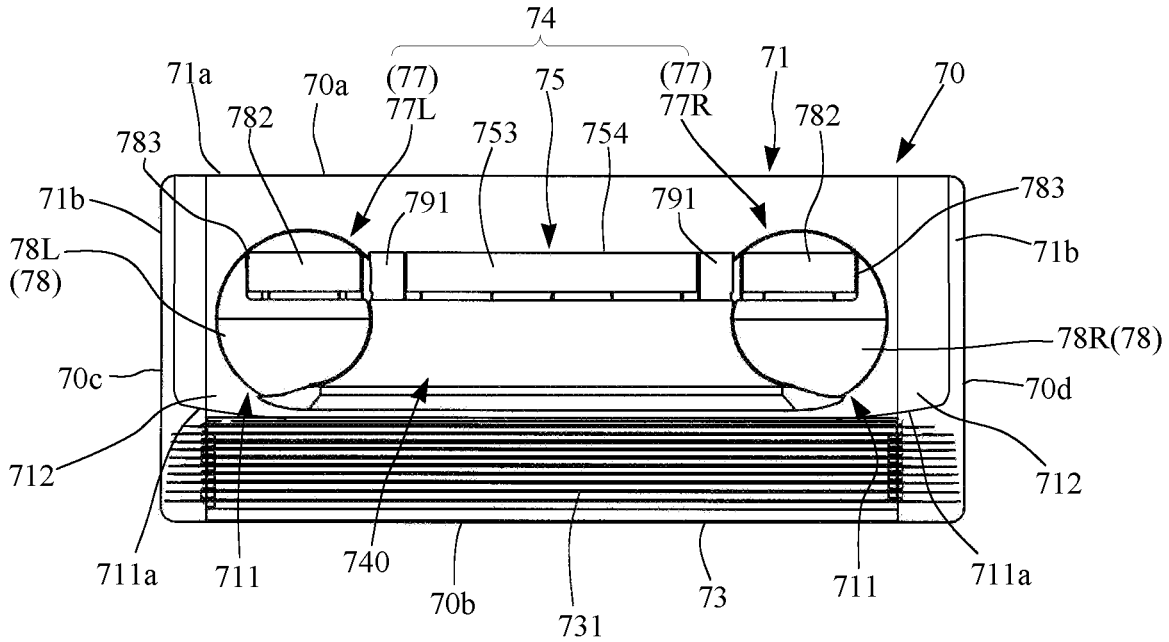
FIG. 11 is a bottom view of the decorative panel viewed from the air-conditioning room side when an operation is stopped.
Figure 12:
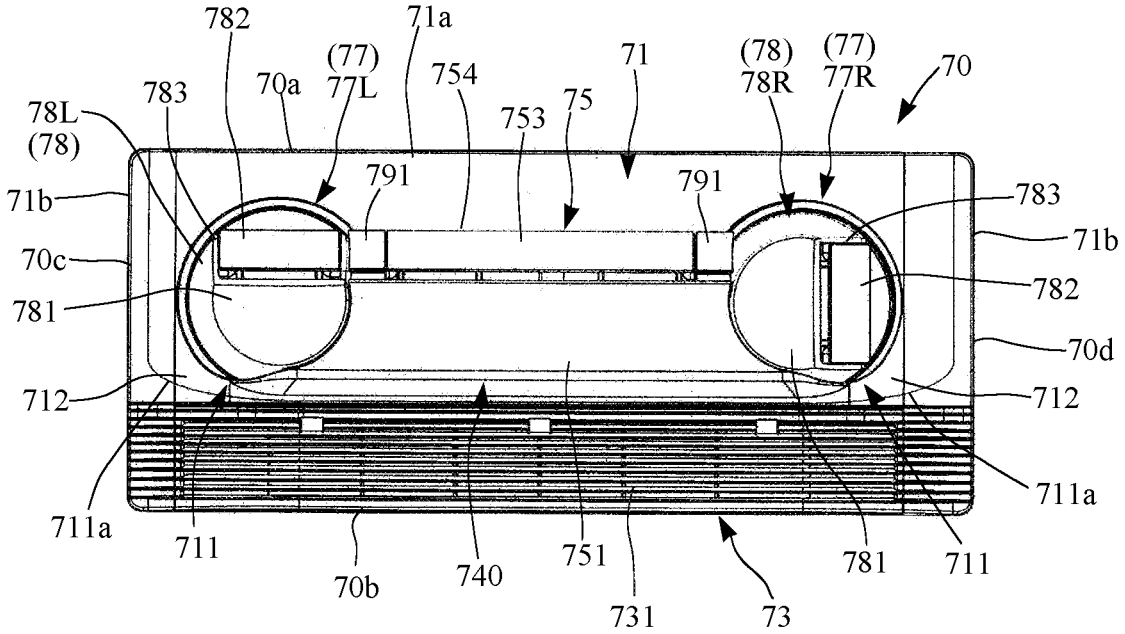
FIG. 12 is a bottom view of the decorative panel during operation viewed from the air-conditioning room side.
Figure 13:
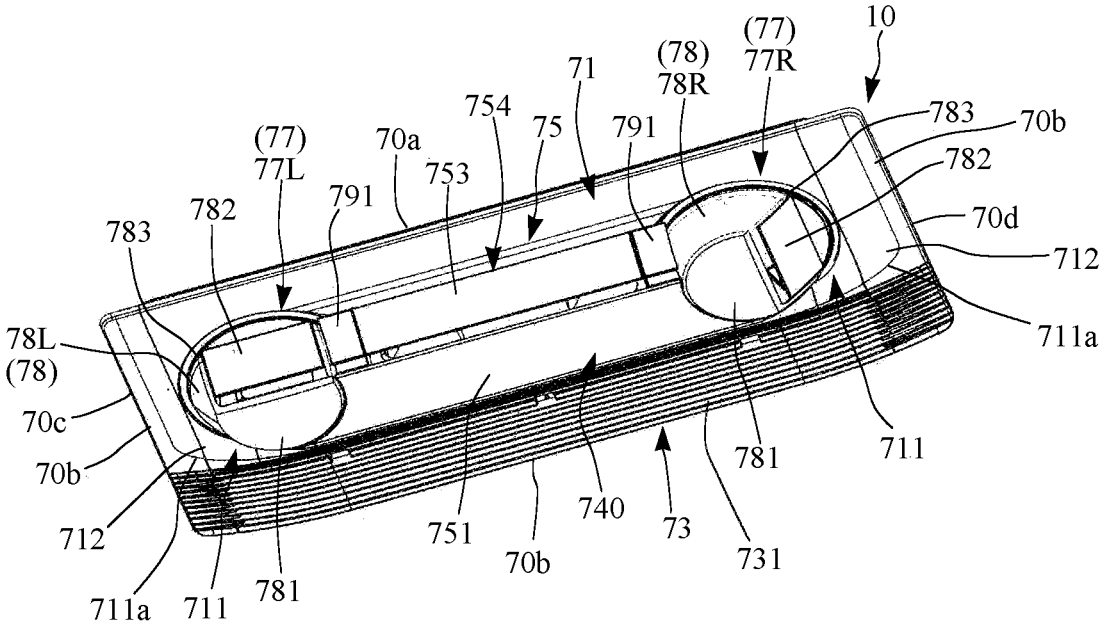
FIG. 13 is a perspective view of FIG. 12.

Referring to FIG. 11 to FIG. 13, the configuration of the decorative panel 70 will be described. The decorative panel 70 has the air blowing part 74 on the one long side 70*a* side, and the air suction part 73 on the side of the other long side 70*b*. The air blowing part 74 is in particular formed as a raised part 740 in which a portion of the panel part 71 is raised in a trapezoidal shape in a cross-section along the long side 70*a* toward the air-conditioning room R. Note that a suction grill 731 having an air filter, is detachably mounted on the air suction part 73.

According to the present embodiment, the raised part 740 is ellipsoidal, which is a rectangular shape with rounded corners including two parallel lines of equal length and two semicircles, and has a side surface (peripheral surface) forming an inclined surface. The air blowing part 74 has a fixed blowing part 75 in the center portion of the raised part 740 and has movable blowing parts 77L, 77R on both left and right sides. When it is not necessary to distinguish between movable blowing parts 77L and 77R, they are collectively referred to as movable blowing part 77.

Figure 16:
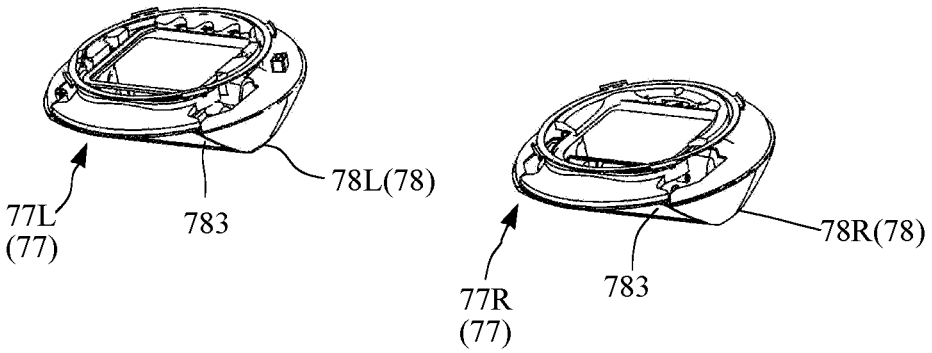
FIG. 16 is a perspective view illustrating a rotating unit to be mounted on the partitioning plate unit.

Referring in conjunction with FIG. 16, the movable blowing part 77L has a truncated cone-shaped rotating unit 78L that rotates within a predetermined range of angles around the axis that is normal to a virtual plane on the rear surface 70R side of the decorative panel 70 parallel to the bottom surface 101 of the body unit 10. The movable blowing part 77R likewise has a truncated cone-shaped rotating unit 78R that rotates within a predetermined range of angles around the axis that is normal to a virtual plane on the rear surface 70R side of the decorative panel 70 parallel to the bottom surface 101 of the body unit 10. The virtual plane on the rear surface 70R side of the decorative panel 70 is also parallel to the ceiling surface T1 of the air-conditioning room R.

Semicircular portions are formed at both ends of the raised part 740 by a portion of these rotating units 78L and 78R. When it is not necessary to distinguish between rotating units 78L and 78R, they are collectively referred to as rotating unit 78.

As can be seen from the perspective view of FIG. 13, a top surface (bottom surface) 751 of the fixed blowing part 75 and a top surface (bottom surface) 781 of the rotating unit 78 are always on the same plane, even when the rotating units 78 are in a rotated state, to improve the design.

The fixed blowing part 75 is a trapezoidal shape in a cross-section, with a first air blowing port 754 opening on a side surface on the front long side (specified side) 70*a* side and facing the long side 70*a*, is provided with horizontal air vent deflectors 752 (see FIG. 15) within a first air blowing port 754, and is provided with a vertical air vent deflector 753 on the opening surface of the first air blowing port 754.

The movable blowing part 77 is provided with a second air blowing port 783 on a portion of the side surface of the rotating unit 78, and the second air blowing port 783 is provided with a vertical air vent deflector 782. Since the rotation of the rotating unit 78 changes the direction of the flow of air in the left and right directions, the movable blowing part 77 does not need a horizontal air vent deflector. The first air blowing port 754 of the fixed blowing part 75 and the second air blowing port 783 of the movable blowing part 77 are opened along the side surfaces having the same angle of inclination in order to give a sense of design unity to these air blowing ports 754 and 783.

While the air blowing direction of the fixed blowing part 75 is in the direction of the long side 70*a*, the movable blowing part 77 rotates between a first position where the second air blowing port 783 faces the long side 70*a* and a second position where the same faces the short sides 70*c*, 70*d*, and within this rotational range, the conditioned air sent from the blower fan 31 is blown out in the specified direction.

As illustrated in FIG. 11, when the movable blowing part 77 is in the first position, the first air blowing port 754 and the second air blowing port 783 are linearly aligned. In this case, it is desirable to provide dummy flaps 791 and 791 on both sides of the first air blowing port 754 in order to create the appearance that the first air blowing port 754 and the second air blowing port 783 are continuous. The dummy flaps 791 are also located on the same inclined surface as the first air blowing port 754 and the second air blowing port 783.

FIG. 12 and FIG. 13 illustrate the state in which the left side movable blowing part 77L is in the first position and the right side movable blowing part 77R is in the second position facing the short side 70*d*. By the movable blowing part 77 being configured to be rotatable, the indoor unit 1 is an omnidirectional (multi-directional) blowing type capable of blowing out conditioned air in all directions except in the direction of the long side 70*b* on the rear side.

As illustrated in FIG. 12 and FIG. 13, even if the second air blowing port 783 of the movable blowing part 77 (77L) is rotated to the second position facing the short sides, the portion other than the second air blowing port 783 is the side surface of a cone, thus providing a sense of continuity with the first air blowing port 754 in appearance. In other words, even if the movable blowing part 77 is rotated, the basic shape of the air blowing part 74 (an ellipsoidal ridge shape) is maintained.

According to the present embodiment, the first air blowing port 754 of the fixed blowing part 75 and the second air blowing port 783 of the movable blowing part 77 are formed on the side surface of a raised part 740 with a portion of the panel part 71 raised in a trapezoidal shape in a cross-section toward the air-conditioning room R side, so that conditioned air is blown out from the first air blowing port 754 and the second air blowing port 783 in an almost horizontal direction along the panel surface 70S of the decorative panel 70, allowing the conditioned air to spread farther away.

Also, although the conditioned air is blown out of the first air blowing port 754 and the second air blowing port 783 at the same time, it is difficult to create a boundary between the air flow blown out of the first air blowing port 754 and the air flow blown out of the second air blowing port 783, so that the air-conditioning room R is uniformly conditioned.

Unlike the above-described embodiment, the first air blowing port 754 and the second air blowing port 783 may be opened in a vertical plane that is normal to the panel surface (or ceiling surface) of the decorative panel 70.

In the above-described embodiment, the fixed blowing part 75 and the left and right movable blowing parts 77 are contained within the ellipsoidal raised part 740. However, as long as the movable blowing part 77 can be rotated around an axis that is normal to the virtual plane on the rear surface 70R side of the decorative panel 70 parallel to the bottom surface 101 of the body unit 10, it may be simply an aspect in which the movable blowing parts 77 are disposed on both sides of the fixed blowing part 75 irrespective of the appearance, and this aspect is also included in the present invention.

Figure 14:
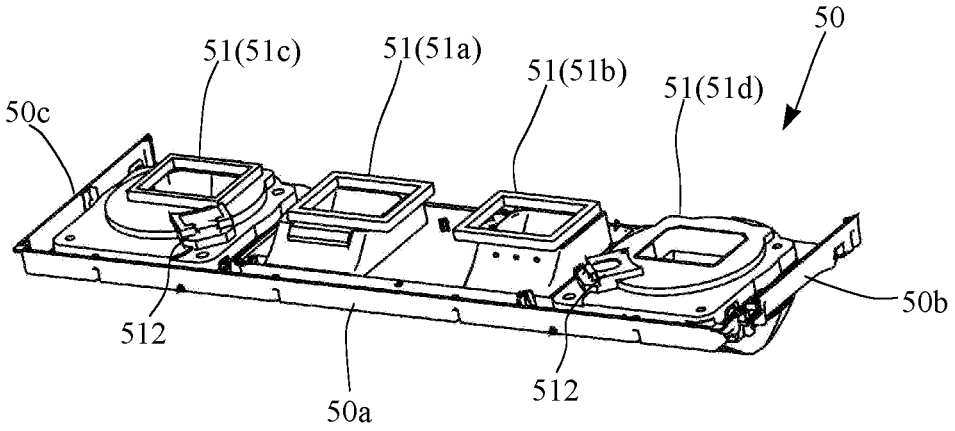
FIG. 14 is a perspective view illustrating a partitioning plate unit to be mounted on a rear surface side of the decorative panel.

On the rear surface 70R side of the decorative panel 70, a partitioning plate unit 50 illustrated in FIG. 14 is mounted. Referring in conjunction with the preceding FIG. 4, FIG. 9, etc., the partitioning plate unit 50 includes, on its upper surface side (the surface side facing the drain pan 40), four ducts 51 (51*a* to 51*d*) which are each fitted to the four ventilation holes 43 (43*a* to 43*d*; see FIG. 9) formed in the drain pan 40 and communicated with the air-blowing section 343 of the fan unit 30.

In the present embodiment, the ventilation holes 43 (43*a* to 43*d*) are square holes, and the ducts 51 (51*a* to 51*d*) fitted thereto are square tubular shapes (the shape of a square tube), and the ducts 51 (51*a* to 51*d*) extend as square tubes to the rear surface 70R of the decorative panel 70.

Two of these ducts 51*a*, 51*b* on the inner side are fitted to the corresponding ventilation holes 43*a*, 43*b*, respectively, and two ducts 51*c*, 51*d* disposed on the outside are fitted to the corresponding ventilation holes 43*c*, 43*d*, respectively.

Figure 15:
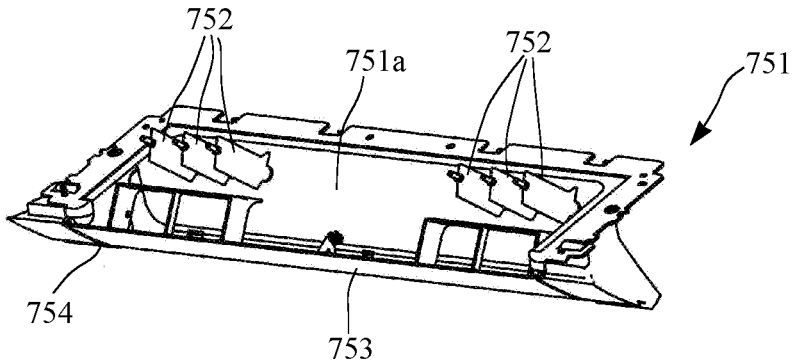
FIG. 15 is a perspective view illustrating a central blowing unit to be mounted on the partitioning plate unit.

The ducts 51*a* and 51*b* are the ducts for the fixed blowing part 75, and as illustrated in FIG. 15, a central blowing unit 751 with one chamber 751*a*, which is allocated across the ducts 51*a* and 51*b*, is mounted on the lower surface side of the partitioning plate unit 50.

The horizontal air vent deflectors 752 are provided in chamber 751*a*. The first air blowing port 754 is formed on the front surface side of the central blowing unit 751, and the vertical air vent deflector 753 is provided therein.

Although not illustrated, a motor to drive the horizontal air vent deflectors 752 is disposed on the back surface of chamber 751*a*, and a motor to drive the vertical air vent deflector 754 is disposed beside the first air blowing port 754.

The outer ducts 51*c* and 51*d* are ducts for the movable blowing part 77, and as illustrated in FIG. 16, a rotating unit 78L provided on the left side movable blowing part 77L is rotatably mounted on the lower end of the left side duct 51*c*, and a rotating unit 78R provided by the right side movable blowing part 77R is rotatably mounted on a lower end of the right side duct 51*d*.

Both of the rotating units 78L and 78R are driven by a motor. The motor driving the rotating unit 78 is located within a motor cover 512, illustrated in FIG. 14 beside the outer ducts 51*c* and 51*d*.

In the present embodiment, the rotating units 78L, 78R can be rotated from the first position to a position of 90° or more, for example, 100°, as the second position, respectively. However, if rotated to such positions, the short-circuit phenomenon, in which the blown air is sucked into the air suction part 73 instead of being directed to the air-conditioning room R may occur.

To prevent such phenomenon, walls 711 are provided between the rotating units 78 and the air suction part 73, referring to FIG. 11 to FIG. 13.

In the present embodiment, the walls 711 are formed in the form of slopes that rise from portions of the panel part 71 around the rotating units 78 from the short sides 70*c*, 70*d* sides toward between the rotating units 78L, 78R and the air suction part 73 to the height of the top surfaces 781 of the rotating units 78 or to the height of the air suction part 73. In FIG. 11 to FIG. 13, ridge lines 711*a* of walls 711 are illustrated to be sloping.

In this configuration, each wall 711 prevents the short-circuit phenomenon when the rotating unit 78 is rotated to near its maximum rotational position, and the blown air flow will reach farther away along a slope surface 712 of the wall 711. In other words, the wall 711 not only prevents the short-circuit phenomenon, but also functions as an air flow guiding surface that allows the blown air to reach farther away by being provided with a slope surface 712.

According to the present embodiment, the air blown from the first air blowing port 754 and the second air blowing port 783 flows along the panel surface 70S of the decorative panel 70, so that a remaining panel surface 70S of the decorative panel 70, except for the air suction part 73, acts as an air flow guiding surface, including the slope surface 712 of the wall 711.

As explained earlier, the decorative panel 70 is mounted on the body unit 10 by fitting the side wall portion 72 into the bottom surface opening of the body unit 10 and screwing it in place. In the present embodiment, the air suction part 73 is disposed on the first air suction chamber S1 side, and at the time of this assembly, as indicated by arrows in FIG. 6, the air conduction path L is formed to guide part of air sucked from the air suction part 73 to between the bottom surface 40R of the drain pan 40 (see FIG. 3 and FIG. 9) and the rear surface 70R of the decorative panel 70 into the second air suction chamber S2.

Figure 9:
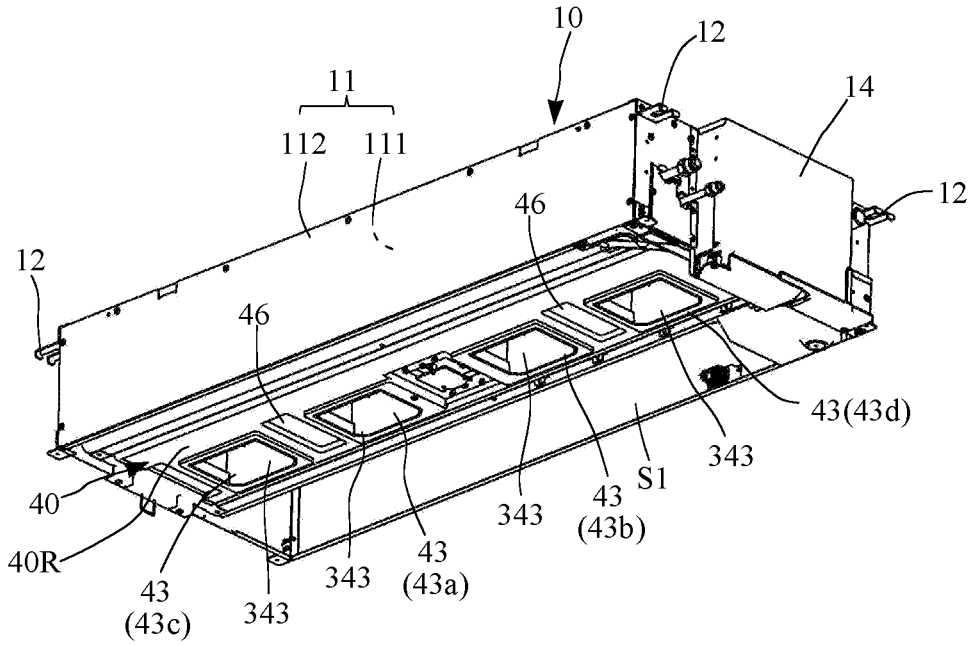
FIG. 9 is a bottom surface side perspective view of the body unit provided in the above-described ceiling-embedded air conditioner.

In the air conduction path L, the air proceeding towards the second air suction chamber S2 passes between the ducts 51, 51, but in order to ensure a greater amount of airflow, recesses 46 are formed in the bottom surface 40R of the drain pan 40 corresponding to the ducts 51, 51 to expand the cross-sectional area of the airflow path L, as illustrated in FIG. 9.

Figure 6:
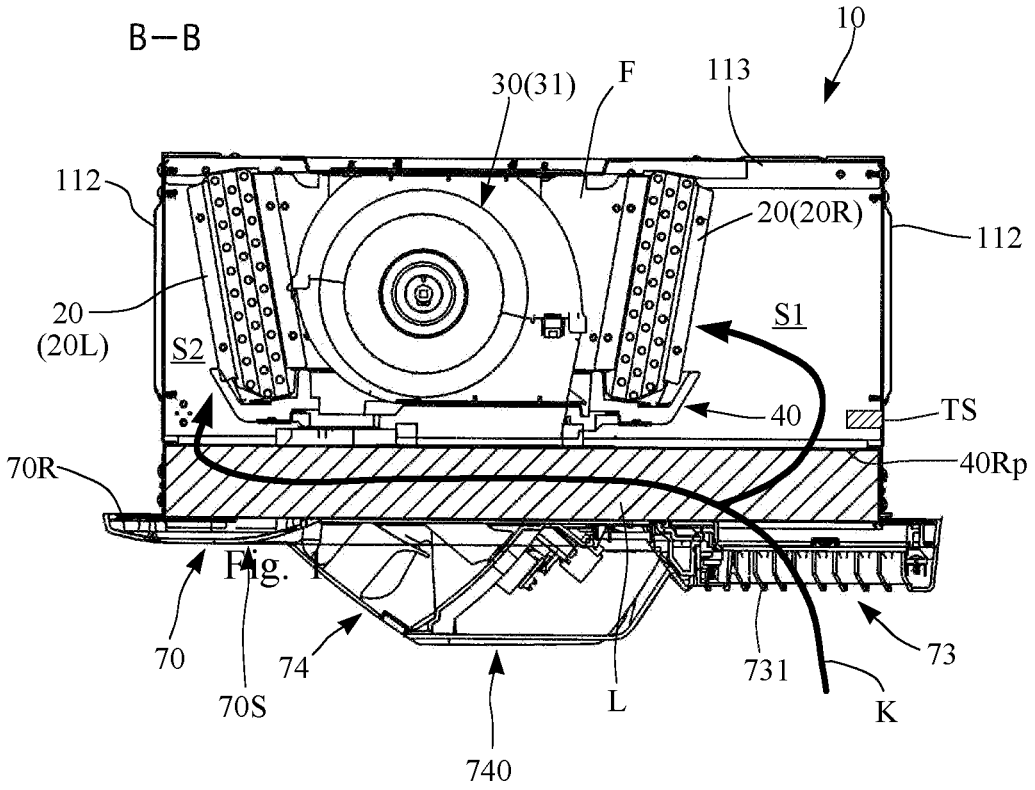
FIG. 6 is a schematic cross-sectional view taken along the B-B line of FIG. 2.
Figure 7:
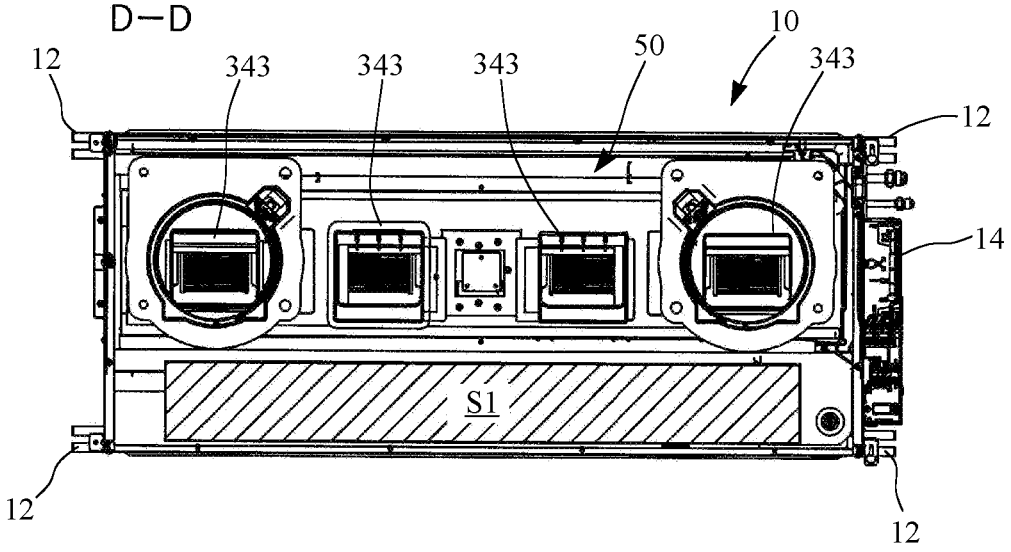
FIG. 7 is a schematic cross-sectional view taken along the D-D line of FIG. 4.
Figure 8:
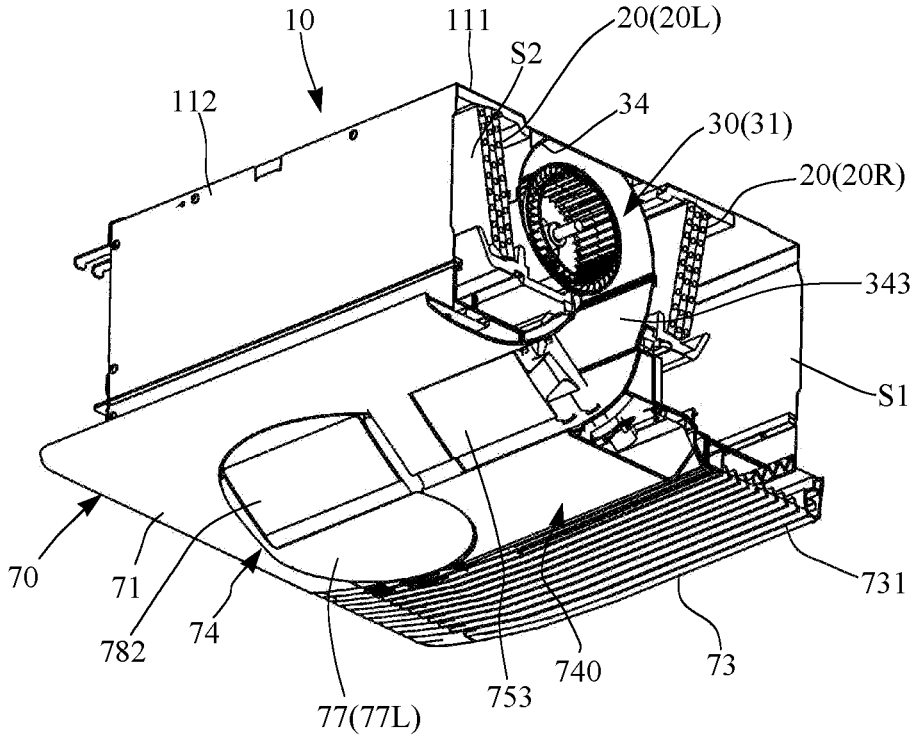
FIG. 8 is a perspective cross-sectional view taken along the B-B line of FIG. 2.

In this indoor unit 1, as illustrated in FIG. 4 and FIG. 6 above, the raised part 740 including a fixed blowing part 75 and a movable blowing part 77 is provided on a decorative panel 70, and the first air blowing port 754 of the fixed blowing part 75 and the second air blowing port 783 of the movable blowing part 77 are formed on the side surface of the raised part 740, so that an air conduction path L larger in vertical width may be ensured between the drain pan 40 and the decorative panel 70.

Referring to FIG. 4 and FIG. 6 above, as viewed from inside the air-conditioning room R, the air suction part 73 is disposed above the raised part 740 and included within the panel surface 70S of the decorative panel 70, so that the air suction part 73 is positionally close to the air conduction path L, and a portion of the air sucked from the air suction part 73 is easily directed to the second air suction chamber S2 side via the air conduction path L.

<Layout of Room Temperature Sensor>

Also, in the present invention, the room temperature sensor for measuring the room temperature in the air-conditioning room R is provided for controlling the air-conditioning operation. However, as described above, when the first air suction chamber S1, the second air suction chamber S2, and the air conduction path L are provided in the body unit 10, the position where to dispose the room temperature sensor becomes an issue for measuring the room temperature with higher accuracy.

Therefore, in this embodiment, as illustrated in FIG. 4 and FIG. 6, a room temperature sensor TS is disposed at a position in the first air suction chamber S1 above the air conduction path L, that is, at a position above a plane 40Rp including the bottom surface 40R of the drain pan 40 which specifies an upper limit of the air conduction path L.

The side of the inner surface of the side plate 112 of the side plates 112, 113 provided on the body unit 10, which is on the side of the long side facing the rear heat exchanger 20R, is preferable. The vicinity of the above-described plane 40Rp in the lower part of the first air suction chamber S1 is more preferable. Such locations, having a larger air volume of indoor air sucked from the air suction part 73 and being far from the heat exchanger, enable measurement of the room temperature with a higher degree of accuracy.

<Assembly>

Next, the assembly of the indoor unit 1 will be described. The body unit 10 is first placed on an assembly table with the top panel 111 side of the outer body 11 down, and the heat insulating material 13 is fitted inside the outer body 11. The pre-assembled heat exchanger 20 (a heat exchanger coupling the front heat exchanger section 20L and the rear heat exchanger section 20R with a coupling plate 21) is then fixed to the top panel 111 via a predetermined mounting fixture, not illustrated, with a gas coupling pipe and a liquid coupling pipe (both not illustrated) of the pre-assembled heat exchanger 20 drawn out of the side plate 113. The pre-assembled fan unit 30 is then placed in the blower chamber F in the heat exchanger 20 and fixed to the top panel 111 via the motor mount 361 and the fan fixing section 341.

Next, the flume section 45 on the drain sheet 42 side of the drain pan 40 is fitted into the bottom surface of the outer body 11 in line with the lower ends of the heat exchanger sections 20L, 20R. At this time, the air-blowing sections 343 of the fan casings 34 are fitted to the ventilation holes 43 of the drain pan 40.

The body unit 10 thus assembled and the decorative panels 70 are packed separately and transported to the installation site. The body unit 10 is installed in the attic T2 by being suspended with a plurality of hanging bolts previously embedded in the attic T2.

Then, the decorative panel 70 is installed from the air-conditioning room R side. At this time, the ducts 51 of the partitioning plate unit 50 are connected to the air-blowing sections 343 of the fan casings 34 through the ventilation holes 43 of the drain pan 40. Although not illustrated, the indoor unit 1 can be operated by connecting refrigerant piping, a power line and signal lines to the outdoor unit.

<Operation>

When the indoor unit 1 is stopped, as illustrated in FIG. 11, the rotating units 78L, 78R of the movable blowing parts 77L, 77R have the second air blowing ports 783 facing in the same direction (on the long side 70*a* side) as the first air blowing port 754 of the fixed blowing part 75, as an initial position (first position), and the first air blowing port 754 and the second air blowing port 783 are both closed by the vertical air vent deflectors 782 and 753.

A compressor and a fan motor of the outdoor unit (both not illustrated) and the fan motor 36 of the indoor unit 1 are then started to operate by a command of the remote controller (not illustrated) by the user or by the command of the air conditioning system.

In the indoor unit 1, the blower fan 31 is rotated by operation of the fan motor 36. The rotation of the blower fan 31 blows out the air in the air-blowing section 343 of the blower fan 31, resulting in a negative pressure in the blower chamber F, so that the air K in the air-conditioning room R is drawn in from the air suction part 73 provided in the decorative panel 70.

Referring to FIG. 6, the air K drawn in from the air suction part 73 flows into the first air suction chamber S1 and also flows into the second air suction chamber S2 through the air conduction path L. The air in the first air suction chamber S1 passes through the rear heat exchanger section 20R, is heat exchanged with the refrigerant, and enters the blower chamber F. Similarly, the air in the second air suction chamber S2 passes through the front heat exchanger section 20L, is heat exchanged with the refrigerant, and enters the blower chamber F.

The air thus conditioned is delivered by rotation of the blower fans 31 from the air-blowing sections 343 of the fan casings 34 to the fixed blowing part 75 and the movable blowing parts 77 of the decorative panel 70 via the ducts 51.

The conditioned air delivered to the fixed blowing part 75 is blown from the first air blowing port 754 toward the direction guided by the horizontal air vent deflectors 752 and the vertical air vent deflector 753. The conditioned air delivered to the movable blowing part 77 is blown out in the direction of rotation of the rotating unit 78 and in the direction guided by the vertical air vent deflector 782.

Since the rotation of the rotating units 78L, 78R is individually controllable, the conditioned air can be supplied in many directions according to the user's requirements, except in the direction of the long side 70*b* on the rear side, where the air suction part 73 is located.

<Support Structure of Partitioning Plate Unit>

The indoor unit 1 of the present embodiment has a partitioning plate unit 50 illustrated in FIG. 14 on the rear surface 70R of the decorative panel 70, as previously described. The partitioning plate unit 50 is mounted on the air blowing part 74 of the decorative panel 70, but is large and heavy because of the fixed blowing part 75, the movable blowing part 77, and the like provided thereon.

The frame 721 described in FIG. 10 is provided on the rear side of the decorative panel 70 with the intention of preventing damage due to impact, such as when dropped. However, here, as illustrated in FIG. 17, a frame 760 is provided to support the partitioning plate unit 50 on the rear surface 70R side of the decorative panel 70.

Figure 17:
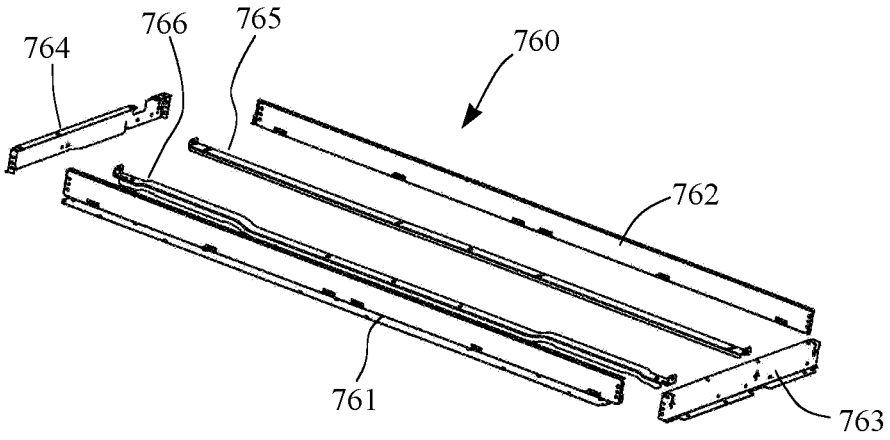
FIG. 17(*a*) is an exploded perspective view illustrating the frame supporting the partitioning plate unit, and (b) is a perspective view illustrating the state in which the same frame is disposed on the rear surface of the decorative panel.
Figure 17:
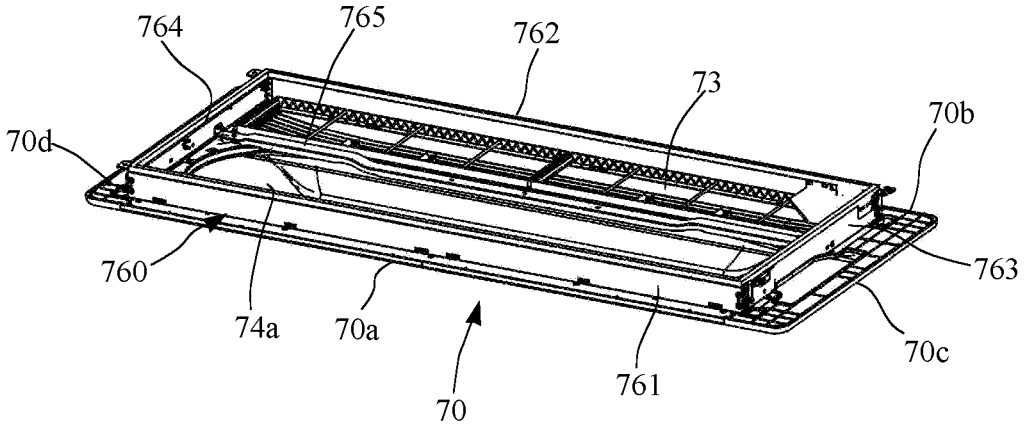

As illustrated in FIG. 17(*a*), the frame 760 includes, as a main frame, long side frames 761 and 762 disposed respectively along the long sides 70*a* and 70*b* of the decorative panel 70, and short side frames 763 and 764 disposed respectively along the short sides 70*c* and 70*d* of the decorative panel 70 between both ends of the long side frames 761 and 762.

Two beams 765, 766 are bridged between the short side frame 763 and the short side frame 764. The long side frames 761 and 762, short side frames 763 and 764 and beams 765 and 766 are preferably made of sheet metal.

As illustrated in FIG. 17(*b*), the partitioning plate unit 50 is mounted on the decorative panel 70 so that the fixed blowing part 75 and the movable blowing part 77 thereof protrude to the air-conditioning room R side, and the opening 74*a*, which corresponds to the air blowing part 74, is formed along the long side 70*a* of the decorative panel 70.

The beams 765 and 766 are disposed respectively on the side of the long side of the opening 74*a* where the air blowing part 74 is provided, and the partitioning plate unit 50 is supported by the beams 765 and 766 on the rear surface 70R side of the decorative panel 70.

Note that the partitioning plate unit 50 is mounted on the rear surface 70R of the decorative panel 70 with its three edges, a front edge 50*a*, a right side edge 50*b*, and a left side edge 50*c*, surrounded by the long side frame 761 at the front and the short side frames 763, 764 on the left and right, respectively, and fitted into the frame 760. As a result, the beams 765, 766 are sandwiched between the partitioning plate unit 50 and the rear surface 70R of the decorative panel 70.

In this configuration, the partitioning plate unit 50 can be mounted on the rear surface of the decorative panel 70 without causing deformation or distortion to the decorative panel 70.

<Configuration of Movable Blowing Part>

Figure 18:
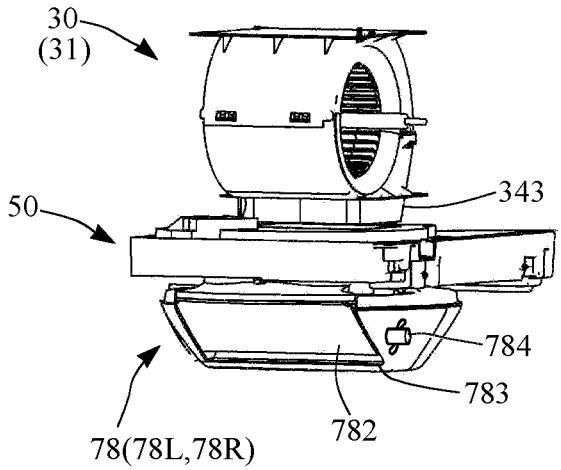
FIG. 18 is an external perspective view illustrating a fan unit and a movable blowing part.
Figure 19:
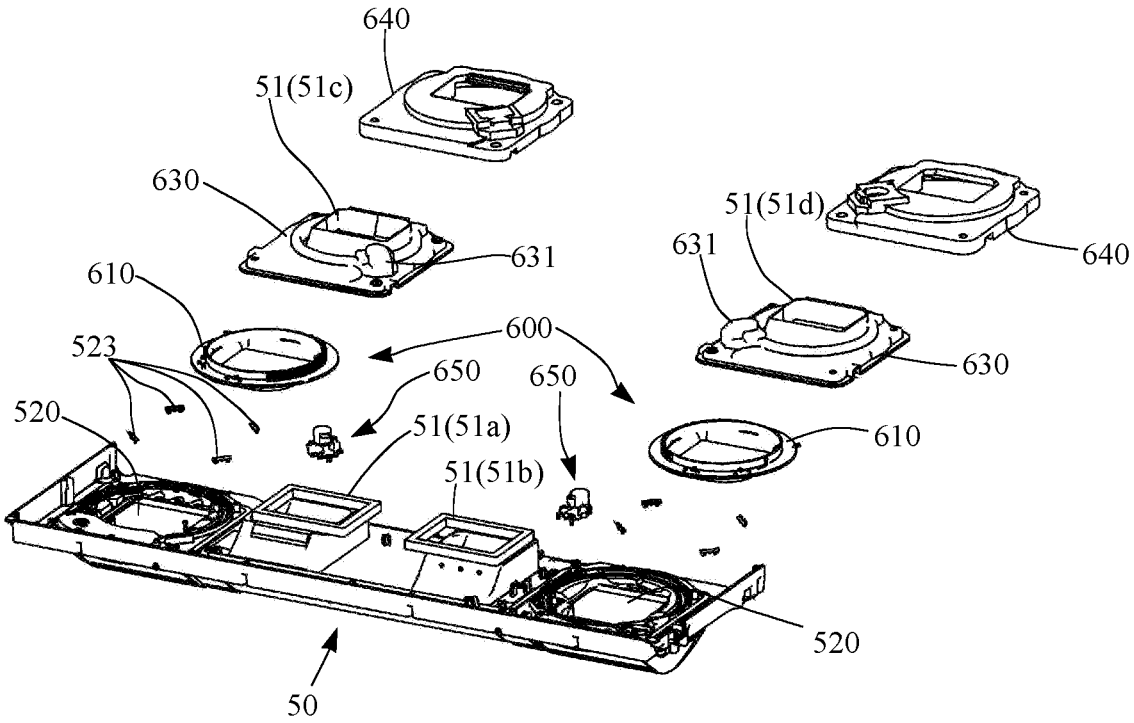
FIG. 19 is an exploded perspective view of a partitioning plate unit including drive means of the rotating unit.

As illustrated in FIG. 18, the fan unit 30 and the rotating unit 78 (78L, 78R) are connected via the partitioning plate unit 50 so that air can be circulated, but as illustrated in the exploded perspective view in FIG. 19, the partitioning plate unit 50 is provided with drive means 600 to rotate the rotating unit 78. The drive means 600 is provided in each of the rotating units 78L and 78R, but the configuration is the same.

Figure 20:
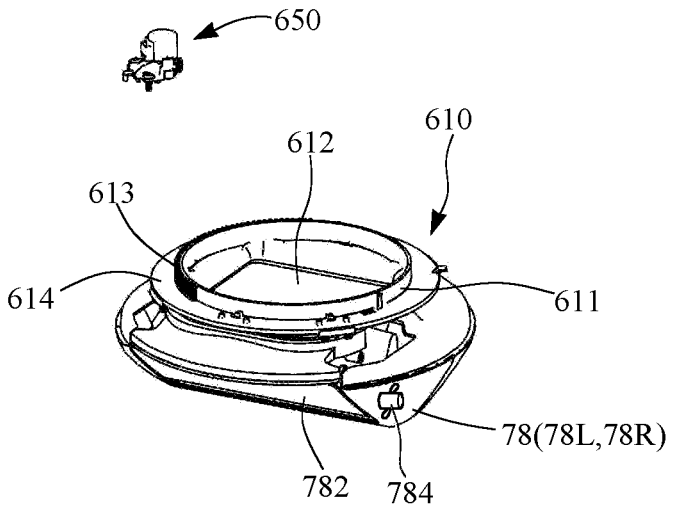
FIG. 20 is a perspective view illustrating the rotating unit with a rotating ring attached thereto.
Figure 21:
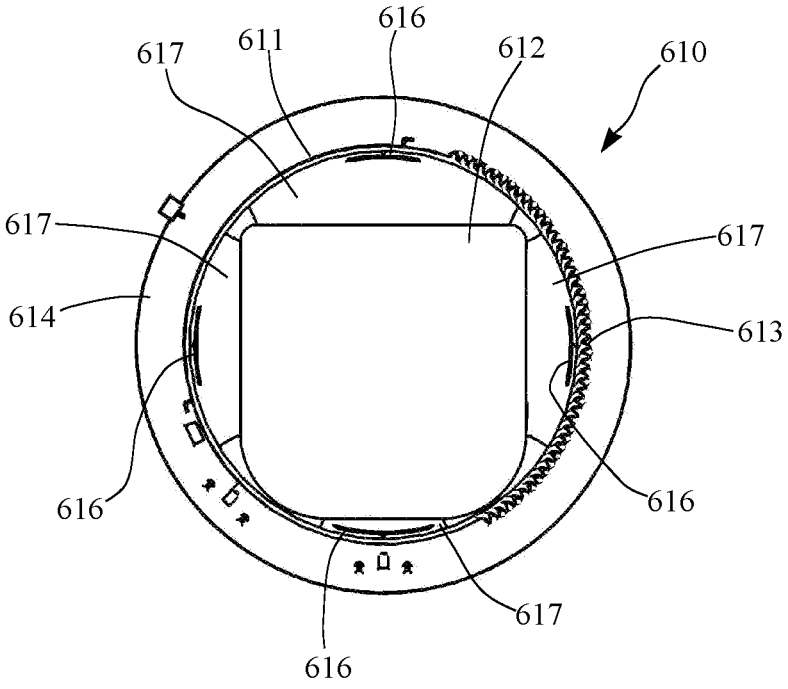
FIG. 21 is a plan view illustrating a rotating ring.

Referring in conjunction with FIG. 20 and FIG. 21, the drive means 600 is provided with a annular rotating ring 610 that is integrally coupled to an upper part of the rotating unit 78 and a motor unit 650 that rotates the rotating ring 610.

The rotating ring 610 has a cylindrical part 611, and on the outer periphery of the cylindrical part 611, rack teeth 613 are formed along the arcuate surface of the outer periphery. The rack teeth 613 may be formed over the entire circumference of the cylindrical part 611 but need only be formed at least in a range that can realize the rotational range (the above-described range between the first position and the second position) of the rotating unit 78.

A flange 614 is formed outward in a radial direction concentrically around the outer periphery of the cylindrical part 611. The flange 614 is hereafter referred to as an outer flange. In the interior of the cylindrical part 611, a vent hole 612 having a square shape is formed to be communicated with the duct 51 (51*c*, 51*d*) for the movable blowing part.

Figure 22:
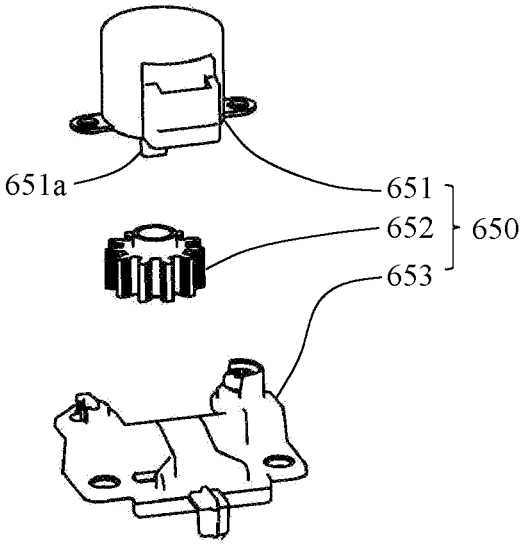
FIG. 22 is an exploded perspective view of a motor unit.

As illustrated in FIG. 22, the motor unit 650 has a motor (preferably a stepper motor) 651 capable of forward and reverse rotation, a pinion gear 652 mounted on an output shaft 651*a* thereof, and a mount 653 for mounting, and the pinion gear 652 is mounted on a predetermined portion of a duct cover 630, which will be described later, so as to engage the rack teeth 613 of the rotating ring 610.

Figure 23:
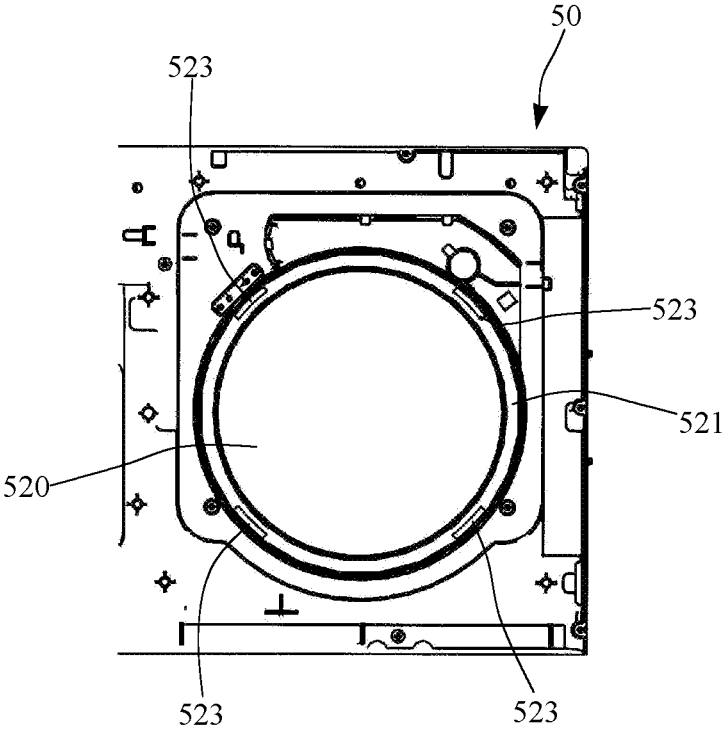
FIG. 23 is a plan view illustrating a portion of the partitioning plate unit including an opening with the rotating ring mounted thereon.

Referring to FIG. 19 and FIG. 23, circular openings 520 are formed on both sides of the partitioning plate unit 50 into which the rotating rings 610 are fitted. On the inner periphery of the opening 520, a flange 521 is formed inward in a radial direction in a concentric manner. The flange 521 is hereafter referred to as an inner flange.

When the rotating ring 610 is fitted into the opening 520, the outer flange 614 is positioned on the inner flange 521, and the outer flange 614 slides on the inner flange 521 as the rotating ring 610 rotates. The outer flange 614 and the inner flange 521 function as a kind of thrust bearing that bears an axial load of the rotating body.

After the rotating ring 610 is fitted into the opening 520, the duct cover 630 is covered to hold the rotating ring 610 down. The duct cover 630 is screwed to the partitioning plate unit 50.

As described above, the ducts 51 (51*c*, 51*d*), that are connected to the ventilation holes 43 formed in the drain pan 40, are formed in the duct cover 630. The duct cover 630 is also formed with a base part 631 on which the motor unit 650 is mounted.

Figure 27:
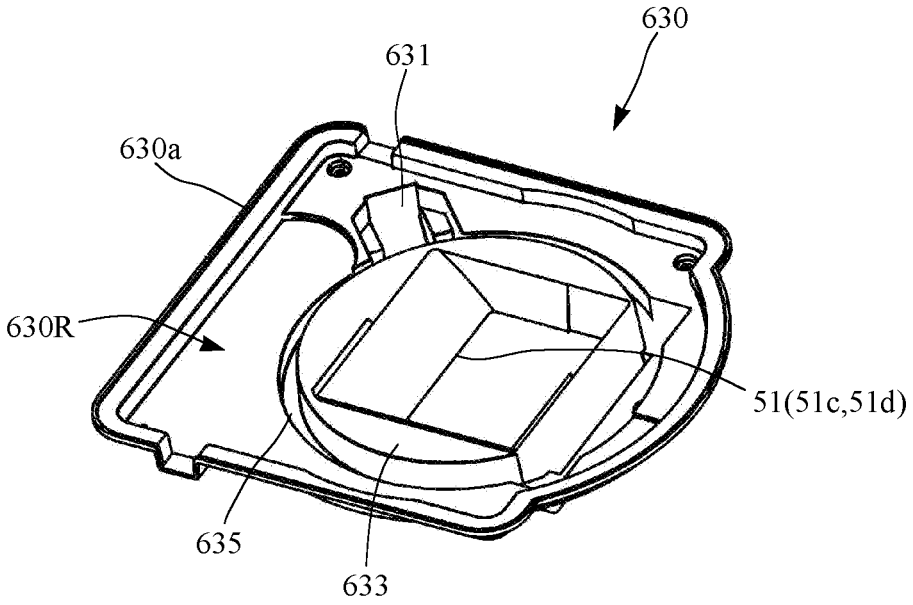
FIG. 27 is a perspective view illustrating a rear surface side of a duct cover.

As illustrated in FIG. 27, the rear surface 630R of the duct cover 630 has an annular guide groove 635 formed therein and the cylindrical part 611 of the rotating ring 610 is fitted in the guide groove 635. The circular portion surrounded by the guide groove 635 on the rear surface 630R of the duct cover 630 is an inner bottom surface 633 at a height slightly lower than an edge 630*a* of the duct cover 630 in FIG. 27 (a height slightly higher than the edge 630*a* in the cross-sectional view in FIG. 28).

The duct 51 (51*c*, 51*d*) is square in shape, but has ventilation area (cross-sectional surface area) progressively widened from the upper surface of the duct cover 630 to the inner bottom surface 633, and widened at the inner bottom surface 633 to an extent that the apex (corner) touches the annular guide groove 635, and the rotating ring 610 rotates along a circumscribed circle of the duct 51 on the inner bottom surface 633 side.

In an airflow path from the fan unit 30 to the second air blowing port 783 of the rotating unit 78, the airflow pressure changes in a rotating portion of the rotating unit 78. However, by rotating the rotating ring 610 along the circumscribed circle of the duct 51 on the inner bottom surface 633 side as described above, the airflow path is not even partially blocked, so that the pressure change in the rotating portion of the rotating unit 78 can be reduced. Also, the structure of the coupling part (connecting part) between the rotating ring 610 and the duct 51 can be reduced in size.

The rotating ring 610 does not have to touch the four apexes of the duct 51, for example, the rotating ring 610 can be made into a large circle that touches the two adjacent apexes of the duct 51 on the inner bottom surface 633 side, and can be rotated without reducing the ventilation area of the duct 51 (without blocking the duct in any part).

Referring again to FIG. 19, according to the present embodiment, the duct cover 630 is further covered with an exterior cover 640. This exterior cover 640 is one size larger than the duct cover 630, but may be omitted in some cases.

When changing the air blowing direction of the rotating unit 78, the rotating ring 610 is rotated in the opening 520 by the motor 651. It is necessary to prevent rattling of the rotating ring 610 from occurring during this rotation. The rattling can be horizontal direction (radial direction) rattling or vertical direction (axial direction) rattling.

Figure 24:
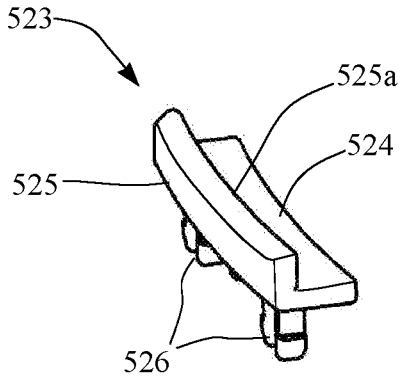
FIG. 24 is a perspective view illustrating a stable seat for preventing horizontal direction rattling of the rotating ring.

First, a stable seat 523, illustrated in FIG. 24, is used to prevent rattling in the horizontal direction (radial direction). The stable seat 523 has a seat portion 524 having a flat shape and a side wall portion 525 that rises almost vertically from one end of the seat portion 524, and an elastically deformable mounting leg 526 with a slot at a bottom of the seat portion 524. The side wall portion 525 is formed with an arcuate surface 525*a* along the outer peripheral edge 614*a* of the outer flange 614.

The stable seats 523 are preferably formed of a low friction resin such as polyacetal (POM) and are provided at four locations at 90° intervals at the base of the inner flange 521 on the outer peripheral side as illustrated in FIG. 23 in this example. As another example, provision at three locations at 120° intervals is also applicable. If the length of the stable seat 523 (the length along the circumferential direction of the inner flange 521) is long, provision at two locations is applicable.

Figure 25:
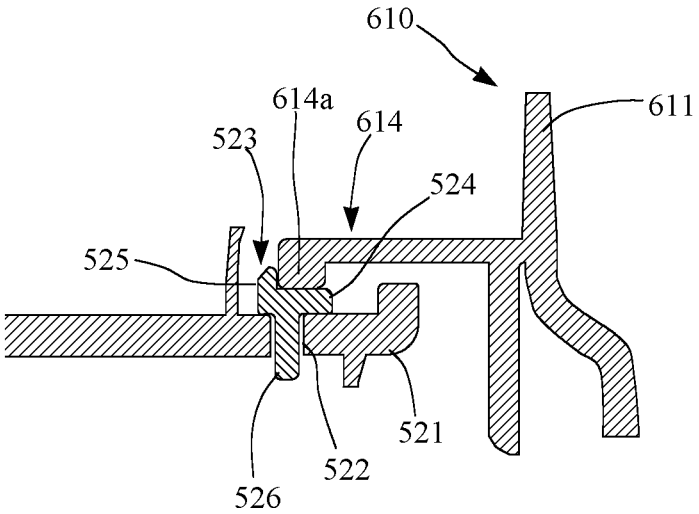
FIG. 25 is a cross-sectional view illustrating a state in which a stable seat is mounted.

The stable seat 523 is mounted on the inner flange 521 along the outer peripheral edge 614*a* of the outer flange 614 of the rotating ring 610. To attach the stable seat 523, however, as illustrated in FIG. 25, an engagement hole 522 may be drilled in the inner flange 521, and the mounting leg 526 may be pushed into the engagement hole 522 while being elastically deformed.

Thus, by providing stable seats 523 on the inner flange 521 side in contact with the outer peripheral edge 614*a* of the outer flange 614 at a plurality of locations, the horizontal direction (radial direction) rattling of the rotating ring 610 can be prevented.

Figure 26:
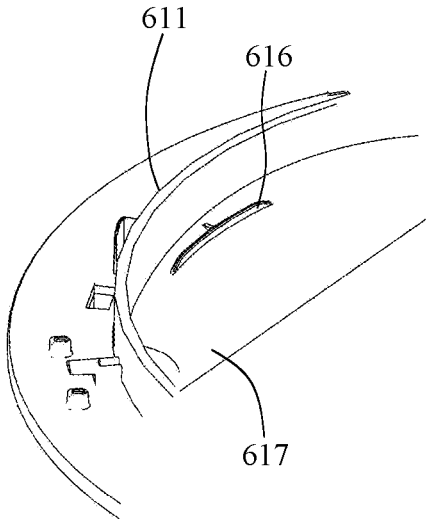
FIG. 26 is a perspective view illustrating a protrusion for preventing vertical rattling of the rotating ring.

Next, to prevent vertical direction (axial direction) rattling, a protrusion 616 is provided in the interior of the cylindrical body 611 of the rotating ring 610, as illustrated in FIG. 26. As described above, the vent holes 612 formed in the cylindrical part 611 are square in shape, so that there is an inner wall 617 in the cylindrical part 611 that forms each side of the square. A protrusion 616 is erected on the inner wall 617.

The position of the protrusion 616 is at a position where it can contact the inner bottom surface 633 on the rear surface 630R of the duct cover 630 illustrated in FIG. 27. In this example, the inner bottom surface 633 is located along three sides of the square openings of the duct 51, while the protrusions 616 are located at four locations at 90° intervals, as illustrated in FIG. 21.

In this way, since the three protrusions 616 are always on the provisional surface 633 regardless of which rotational position the rotating ring 610 is in, the protrusion 616 will not deviate from the inner bottom surface 633, but in order to reduce sliding frictional resistance, the smaller contact area per protrusion 616 to the inner bottom surface 633 preferably should be as small as possible.

Figure 28:
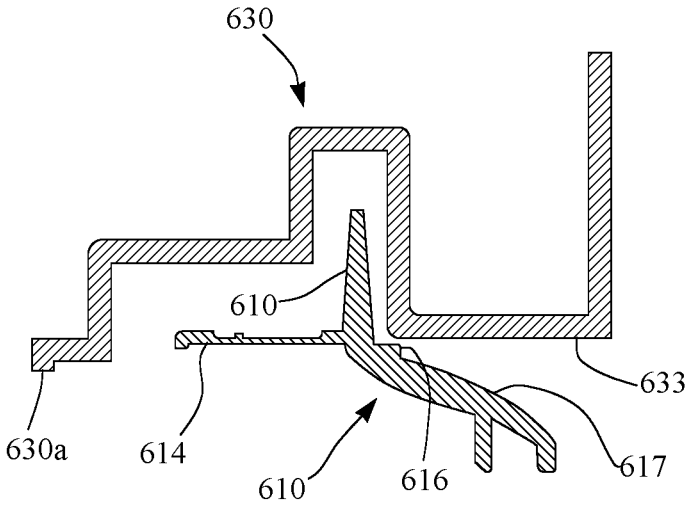
FIG. 28 is a cross-sectional view illustrating function of horizontal rattling of the rotating ring by the protrusion.

The protruding height of the protrusion 616 is the height at which the tip of the protrusion 616 contacts the inner bottom surface 633 when the rotating ring 610 is covered by the duct cover 630, as illustrated in FIG. 28.

Thus, by providing a protrusion 616 inside the cylindrical body 611 of the rotating ring 610 that contacts the inner bottom surface 633 on the rear surface 630R of the duct cover 630, the vertical direction (axial direction) rattling of the rotating ring 610 can be prevented.

As described above, the rotating ring 610 is rotated in the opening 520 of the partitioning plate unit 50 by the motor 651. However, it is necessary to take measures to prevent wind leakage from the gap between the inner flange 521 on the opening 520 side and the outer flange 614 on the rotating ring 610 side, and to prevent dew condensation, especially during cooling operation.

Figure 29:
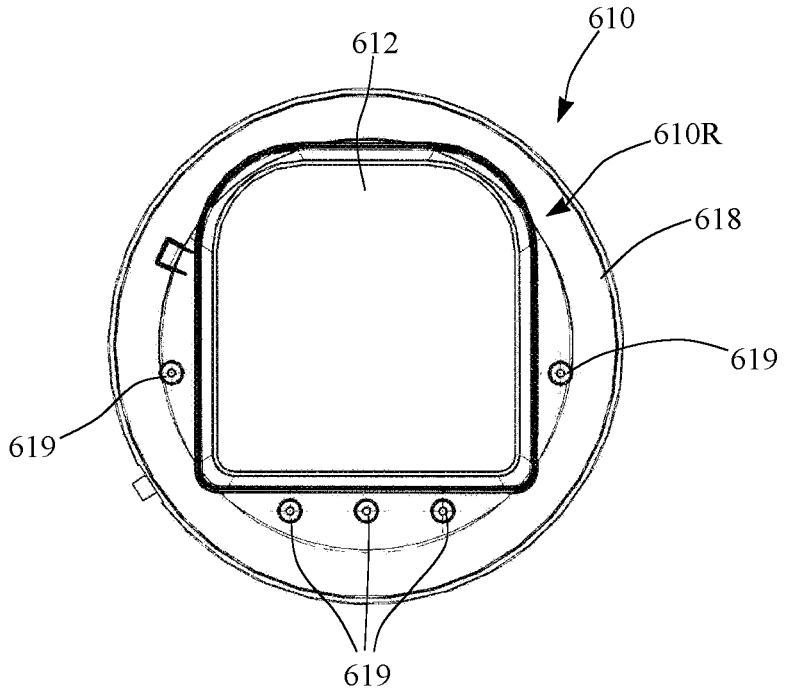
FIG. 29 is a bottom view illustrating the rotating ring.
Figure 30:
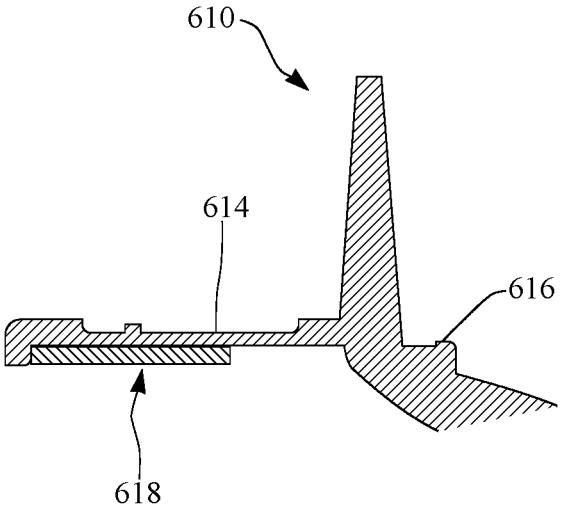
FIG. 30 is a cross-sectional view illustrating an outer flange of the rotating ring with a sealing material mounted thereon.

Therefore, in this example, as illustrated in FIG. 29 and FIG. 30, a sealing material 618 is provided on the inner surface of the outer flange 614 (on the surface side facing the inner flange 521). The sealing material 618 need only have moderate elasticity and heat insulation properties. However, because of being rubbed against the inner flange 521 as the rotating ring 610 rotates, a tape or sheet of fibers made of polyacetal (often short fibers), for example, planted on a tape-shaped or sheet-shaped base material is preferably employed as a low friction fiber.

In this configuration, a clearance between the inner flange 521 and the outer flange 614 can be set substantially on the order of 0 to 0.5 mm to prevent wind leakage. Also, the structure free from dew condensation is achieved. The sliding frictional resistance associated with the rotation of the rotating ring 610 can also be reduced.

As illustrated in FIG. 29, a boss 619, which is used to couple the rotating unit 78, is provided at a plurality of locations on the rear surface 610R side of the rotating ring 610.

<Composition of Fan Unit>

In the fan unit 30 described in the preceding FIG. 3, the blower fan 31 is fixed to the top panel 111 of the outer body 11 via the fan mount 311 in the fan casing 34, and the fan motor 36 is also fixed to the top panel 111 of the outer body 11 via its motor mount 361. This requires a large number of parts to be used and a high degree of accuracy in positioning the blower fan 31 and fan motor 36.

Figure 31:
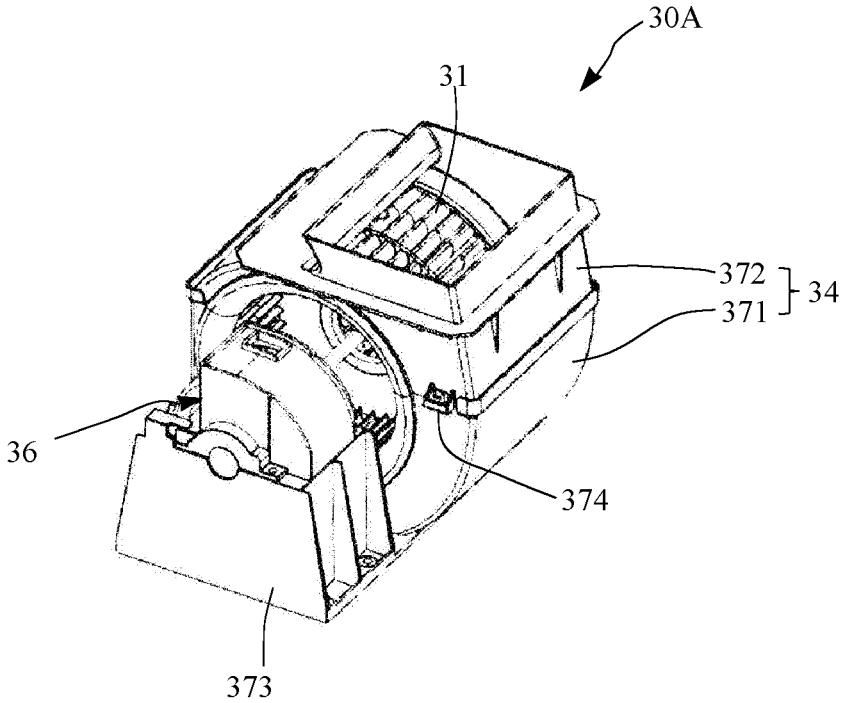
FIG. 31 is a perspective view illustrating an improved fan unit.
Figure 32:
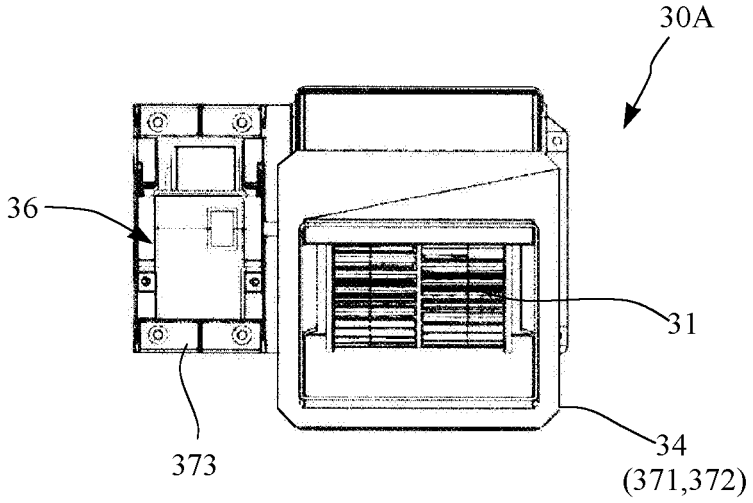
FIG. 32 is a plan view illustrating the above-described fan unit.

FIG. 31 and FIG. 32 are a fan unit 30A with improvement in such points. In the embodiment here also, a sirocco fan is preferably used as the blower fan 31, and the fan motor 36 is used as-is without any particular change required.

In this fan unit 30A, the fan casing 34 of the blower fan 31 is divided into two compartments, a lower casing 371 and an upper casing 372, both of which are made of synthetic resin material, and the lower casing 371 includes a motor mount 373 of the fan motor 36 formed integrally.

A bearing part that supports the blower fan 31 of the lower casing 371 and a bearing part that supports the fan motor 36 of the motor mount 373 (both illustrations are omitted) are pre-centered when the motor mount 373 is integrally molded in the lower casing 371. The upper casing 372 may be secured to the lower casing 371 with a locking device 374 such as a snapping lock, for example.

With the fan unit 30A, the blower fan 31 and the fan motor 36 may be coupled in advance, and by opening the upper casing 372, the blower fan 31 may be housed in the lower casing 371, and the fan motor 36 may be set on the motor mount 373, so that positioning (centering) of the blower fan 31 and the fan motor 36 is easily performed.

Fixation of the outer body 11 to the top panel 111 does not have to be performed separately for the blower fan 31 and the fan motor 36 and all that is needed is to fix only the outer body mounting part (not illustrated) provided on the lower casing 371 to the top panel 111.

Since this fan unit 30A is unitized by the smallest unit, it is only necessary to select the number of units to be used according to the blown out air volume and size of the air blowing part or the like required by the air conditioner, and there is no need to design a fan unit (blower) dedicated to each model with a different air volume. With this fan unit 30A, the air volume can be adjusted individually, thus enabling more detailed air conditioning operation.

<Configuration (1) of Electrical Component Box>

As illustrated earlier in FIG. 2 and FIG. 3, since the electrical component box 14 storing electrical components (not illustrated) for controlling the indoor unit 1 is mounted on an outer surface of the right side surface of the outer body 11, that is, on the outer surface 113*a* of one of the side plates 113 on the side of the short side in this embodiment, the electrical component box 14 does not cause ventilation hindrance.

Figure 33:
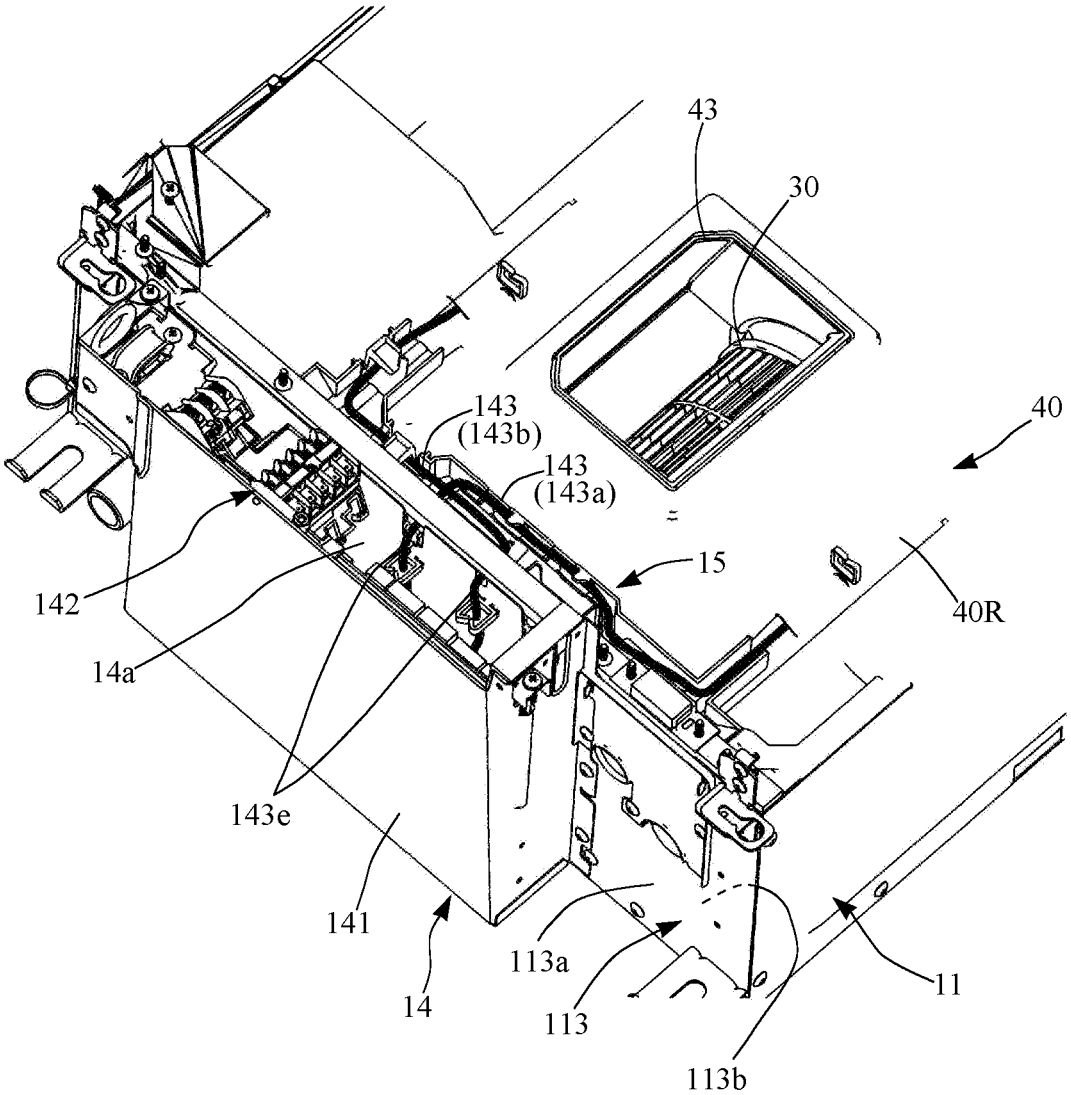
FIG. 33 is a perspective view illustrating an electrical component box mounted on an outer body and a cable storage part.

Referring also to FIG. 33, the electrical component box 14 includes a box body 141 with a surface on the side facing the side panel 71*b* being a bottom surface thereof, and the bottom surface is opened as an opening 14*a*. In order to reduce the number of components, a portion of the box body 141 (the surface of the outer body 11 on the side facing the side plate 113) is preferably formed from the above-described side plate 113.

In this embodiment, a remote controller wiring terminal 142 is disposed to face the opening 14*a* of the electrical component box 14, and lead wire 143, such as a motor lead wire 143*a* and a switch board lead wire 143*b*, are drawn out from the opening 14*a*.

The cable storage part 15 is provided on the side of the inner surface 113*b* of the side plate 113, where the electrical component box 14 is mounted. The cable storage part 15 also serves as a cable guide which stores and guides the drawing section of the lead wire 143 drawn out from the electrical component box 14 in a predetermined direction.

The cable storage part 15 is fitted into the drain pan 40 to be flush with the bottom surface 40R of the drain pan 40. For this reason, a recess 47 for fitting the cable storage part 15 is formed at a corner of the bottom surface 40R of the drain pan 40, as illustrated in FIG. 34(*a*).

Figure 34:
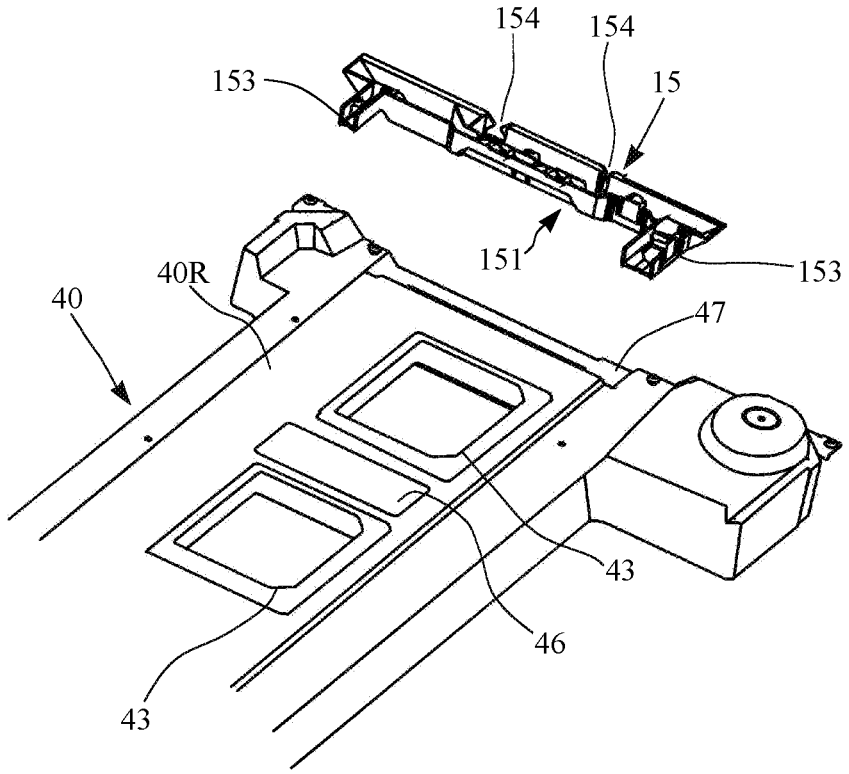
FIG. 34(*a*) is a perspective view illustrating a cable storage part and a drain pan separately, and (b) is a plan view illustrating only a cable storage part.
Figure 34:
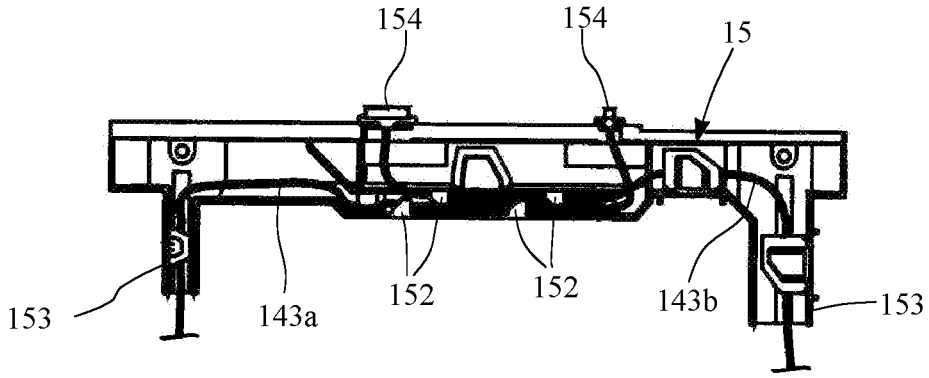

As illustrated in FIG. 34(*b*), the cable storage part 15 has a guide groove 151 for guiding the drawing section of the lead wire 143 in a predetermined direction formed in the interior thereof, and claw strips 152 for guiding the lead wires 143, 144 into the guide groove in a zigzag pattern are provided at an opening of the guide groove 151.

The cable storage part 15 has, at both sides thereof, wiring guide grooves 153 formed for wiring the lead wire 143 along the bottom surface 40R of the drain pan 40. The cable storage part 15 also has locking grooves 154, having a clipping function, for pushing the drawing sections 143*e* of the lead wire 143 from the electrical component box 14 down formed at an edge of a side touching the side plate 113.

In this manner, by disposing the cable storage part 15 on the side of the inner surface 113*b* of the side plate 113 on which the electrical component box 14 is mounted, a wiring substrate, not illustrated, with the lead wire 143 attached thereto can be inserted into the opening 14*a* of the electrical component box 14 to put the drawing section of the lead wire 143 to be flush with the bottom surface 40R of the drain pan 40. The electrical component box 14 can be easily accessed during maintenance.

<Configuration (2) of Electrical Component Box>

Figure 35:
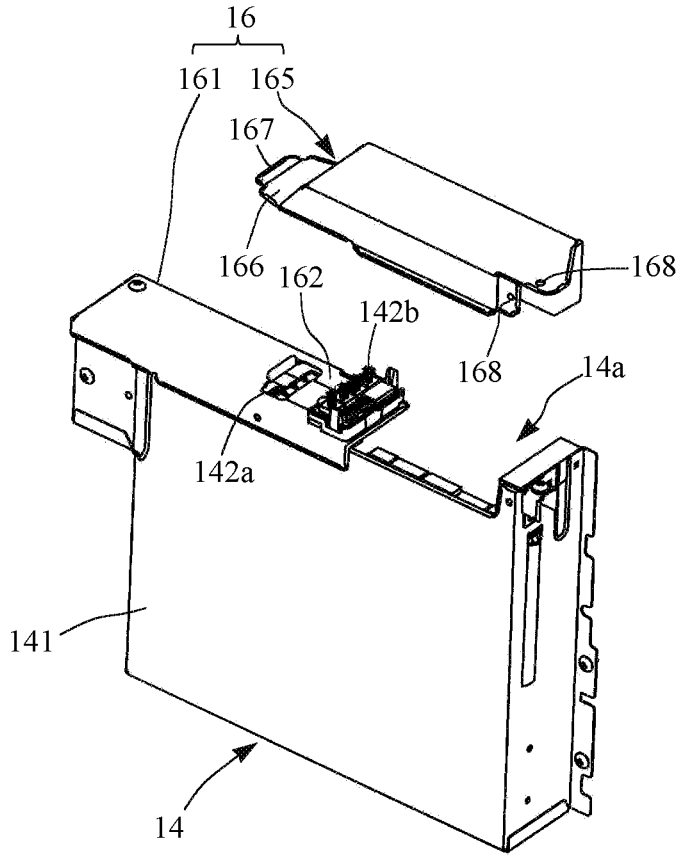
FIG. 35(*a*) is a perspective view illustrating a state in which part of a lid member (second lid portion) mounted on an opening of the electrical component box is removed, and (b) is a perspective view illustrating a state in which the opening of the electrical component box is closed with the lid member.
Figure 35:
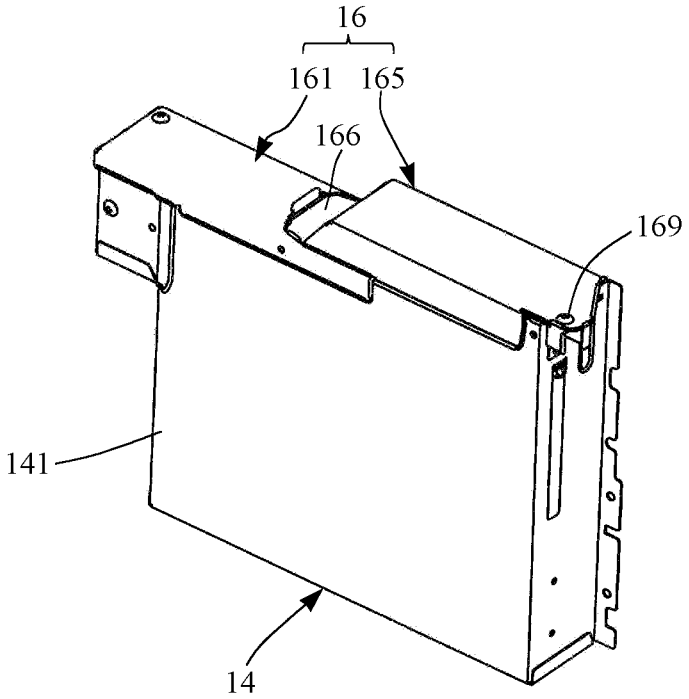

Subsequently, referring to FIG. 35 and FIG. 36, the electrical component box 14 is provided with a lid member 16 that blocks the opening 14*a*. The lid member 16 includes two members; a first lid portion 161 configured to block one end portion side of the opening 14*a* and a second lid portion 165 configured to cover the remaining part of the opening 14*a*.

In this embodiment, the first lid portion 161 is a semi-fixed lid which is rarely removed during maintenance, and the first lid portion 161 has a connection terminal part exposing hole 162 formed thereon having a square shape. FIG. 35 illustrates a remote controller wiring terminal 142*a* and a switch board 142*b* having a dip switch for registering an identification number or the like of itself in multiple air-conditioners as connection terminal parts provided in the connection terminal part exposing hole 162.

In contrast, the second lid portion 165 is a lid on the side removed (opened) during maintenance and includes a box body opened in the bottom surface, which can cover the remote controller wiring terminal 142.

The second lid portion 165 includes, at one end side thereof, a flange 166 to continue therefrom that covers a remote controller wiring terminal 142*a* portion of the connection terminal part exposing hole 162, and a tongue strip 167 that engages the edge of the connection terminal part exposing hole 162 is formed at a tip of the flange 166. The second lid portion 165 has, at the other end side thereof, screw holes 168 formed for the electrical component box 14.

In this configuration, the second lid portion 165 can be mounted on the electrical component box 14 by engaging the tongue strip 167 with the edge of the connection terminal part exposing hole 162 and inserting and screwing screws 169 into the screw holes 168 on the other end side. The second lid portion 165 can be detached by removing the screw 169 and pulling out the tongue strip 167 from the connection terminal part exposing hole 162.

Figure 36:
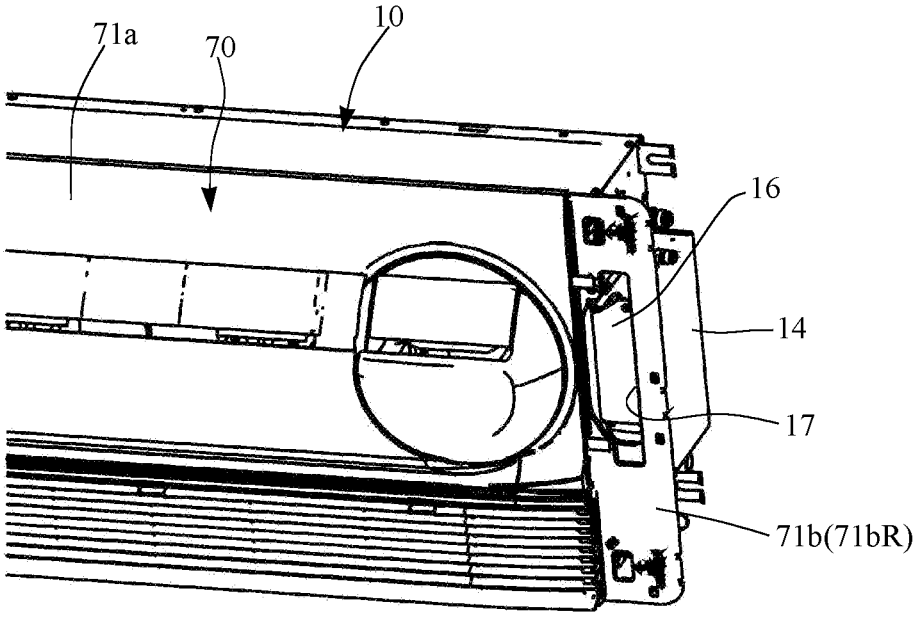
FIG. 36(*a*) is a perspective view for explaining an opening window formed in a side panel, and (b) is a perspective view illustrating a state in which part (second lid portion) of the lid member is taken out from the above-described opening window.
Figure 36:
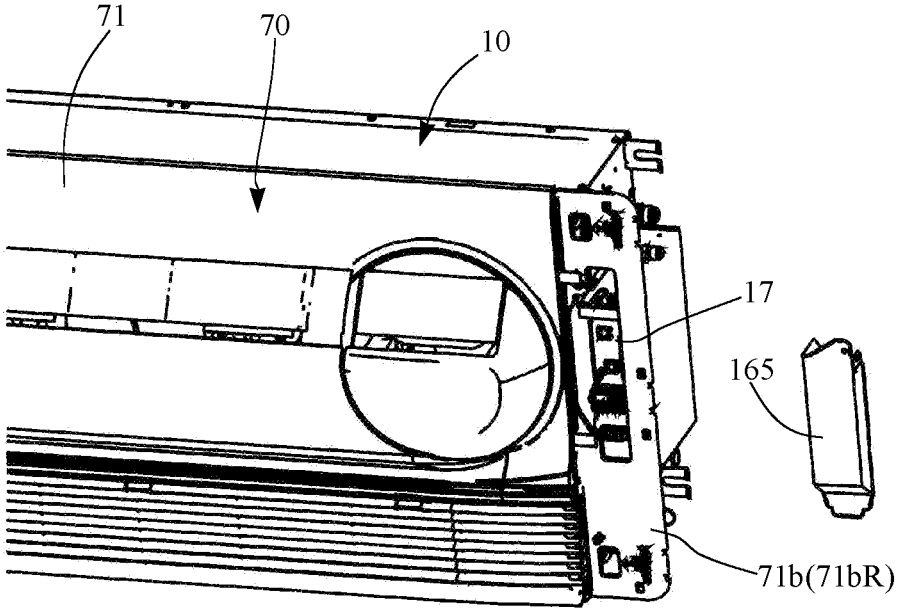

As illustrated in FIG. 36, the side panel 71*b* of the decorative panel 70 (the right-side side panel 71*b*R in the illustrated example) is provided with an opening window 17 for maintenance to access the electrical component box 14. If the opening window 17 is too large, the mechanical strength of the side panel 71*b* is lowered, and, in addition, the indoor air near the ceiling may flow in from the opening window 17 to the attic side and cause dew condensation on the outer body 11.

Accordingly, in the present invention, the opening window 17 is smaller than the entire lid member 16 in a size that allows the second lid portion 165 to be taken out. Note that a side panel cover is normally mounted on the side panel 71*b*, and the opening window 17 is not visible, as illustrated in FIG. 11 to FIG. 13.

In this configuration, during maintenance, access to the interior of the electrical component box 14 is enabled by only removing the above-described side panel cover and the second lid portion 165 as illustrated in FIG. 36(*b*), and, for example, the state of wiring connections of the remote controller wiring terminal 142 and the lead wires 143 can be checked easily.

<Suspension of Decorative Panel>

Since the ceiling-embedded air conditioner is large, the decorative panel 70 is also heavy to some extent, so that the workability when mounting the body unit 10 to the bottom surface or easiness of work during maintenance for inspecting the electrical component box 14 and the fan unit 30, or the like, by removing the decorative panel 70 needs to be considered.

Figure 37:
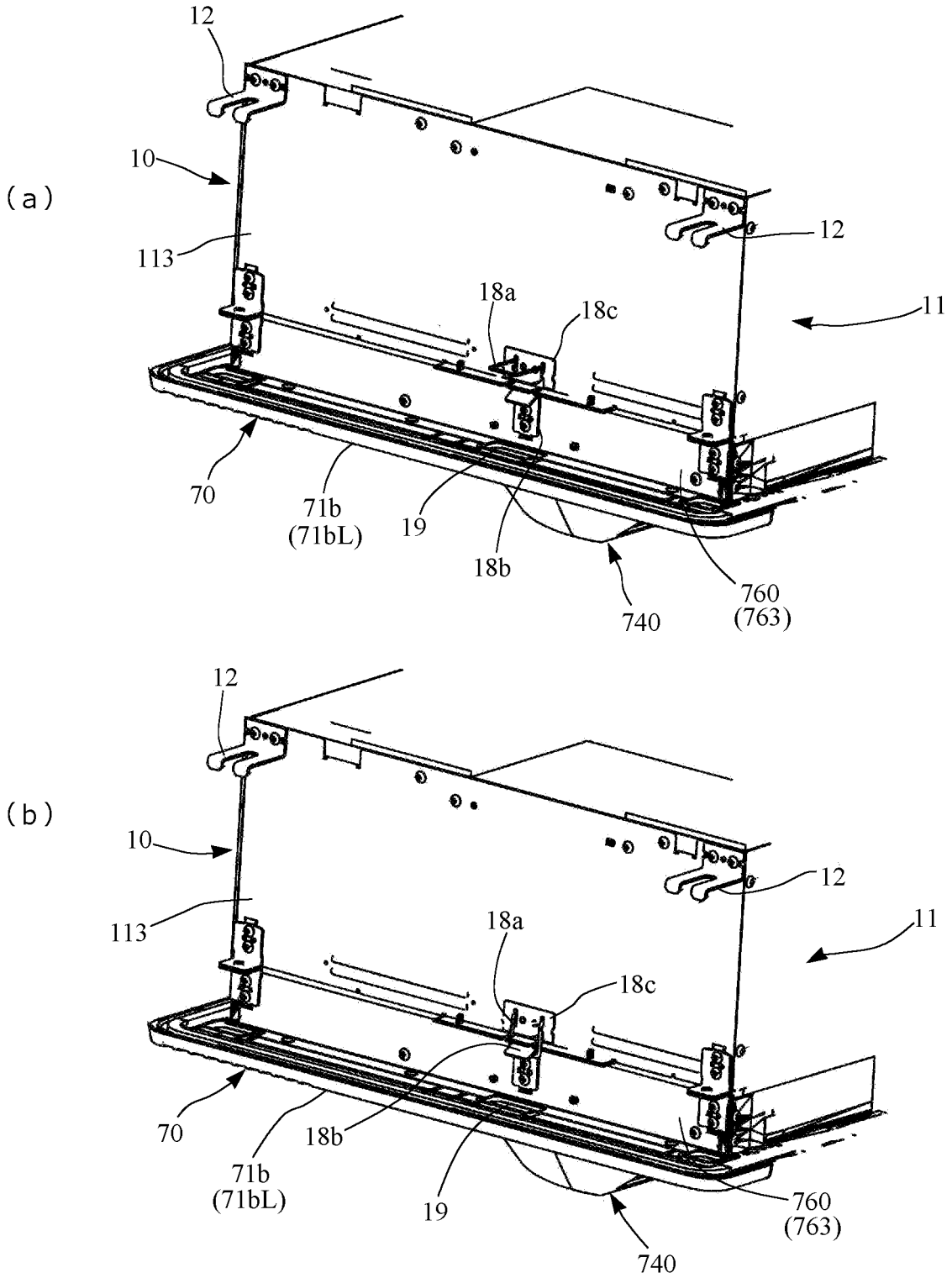
FIG. 37(*a*) (b) are perspective views for explaining the configuration in which the decorative panel can be suspended from the body unit.

Accordingly, to facilitate these works, the present invention provides a suspending member 18*a* on the body unit 10 side and a hook 18*b* attachable to and detachable from the suspending member 18*a* on the decorative panel 70 side, as illustrated in FIG. 37.

Figure 38:
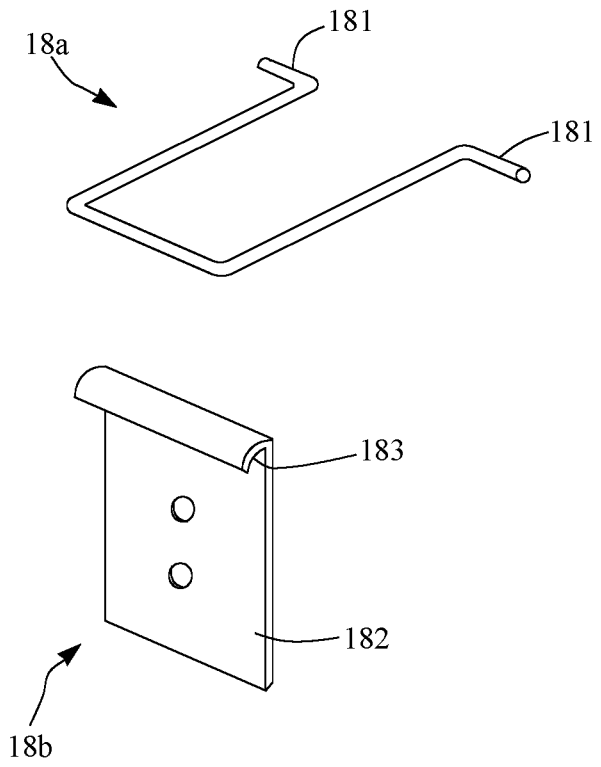
FIG. 38 is a perspective view of a suspending member and a hook for suspending the decorative panel from the body unit.

Referring to FIG. 38, the suspending member 18*a* has rotating shafts 181, 181 formed by bending wire material such as a steel wire into a substantially U-shape and coaxially bending both ends at right angles in directions away from each other. The hook 18*b* preferably is a metallic substrate 182 having a locking claw 183 folded back into a substantially V-shape (or a U-shape) at an upper end thereof.

The suspending member 18*a* may be provided on the side plate 112 of the outer body 11 on the side of the long side. In this embodiment, however, the suspending member 18*a* is supported by the side plate 113 of the outer body 11 on the side of the short side rotatably via the rotating shafts 181, 181. The side plate 113 on which the suspending member 18*a* is mounted is provided with a receiving member 18*c* that axially supports the rotating shafts 181, 181.

Of the two side plates 113, 113 on the side of the short side, the suspending member 18*a* is mounted on the side plate 113 on the opposite side from the side plate 113 on which the electrical component box 14 is mounted. In other words, the electrical component box 14 is mounted on one of the side plates 113, and the suspending member 18*a* is mounted on the other side plate 113.

The hook 18*b* is mounted on the decorative panel 70 side, but in this embodiment, is screwed to a short side frame 763 corresponding to the above-described side plate 113 of the frame 760 that reinforces the decorative panel 70.

In this configuration, when the decorative panel 70 needs to be removed for, for example, performing maintenance of the electrical component box 14 or the like, the decorative panel 70 can be suspended from the outer body 11 of the body unit 10 by hooking the locking claw 183 of the hook 18*b* on the suspending member 18*a*.

According to this embodiment, in order to enable the hook 18*b* to be hooked easily on the suspending member 18*a*, the side panel 71*b* (the left-side side panel 71*b*L) is provided with an opening 19 for viewing the hook 18*b* from the air-conditioning room R side.

Note that the drain pan 40 may also be provided with the hook 18*b* to enable the drain pan 40 to be suspended from the body unit 10 in the same manner as the decorative panel 70, although not illustrated.

<Trapping Structure of Motor Lead Wire>

Figure 39:
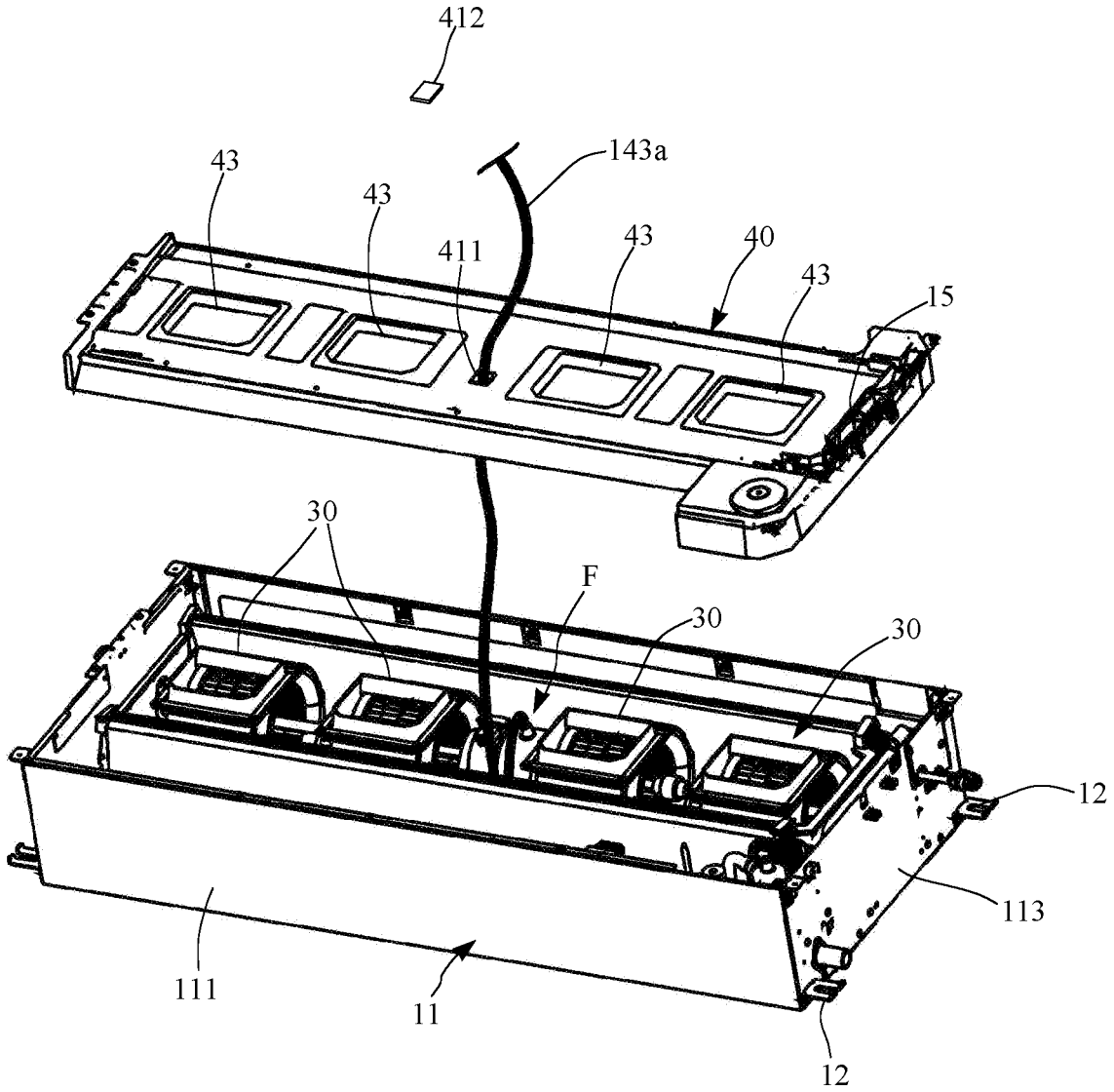
FIG. 39 is a perspective view illustrating a motor lead wire to be drawn into a blower chamber through the drain pan.

Next, referring to FIG. 39, the motor lead wire 143*a* drawn from the electrical component box 14 passes through the lead wire insertion hole 411 drilled in the drain pan 40, is drawn into the blower chamber F in the outer body 11 and is connected to the fan motor 36.

Figure 40:
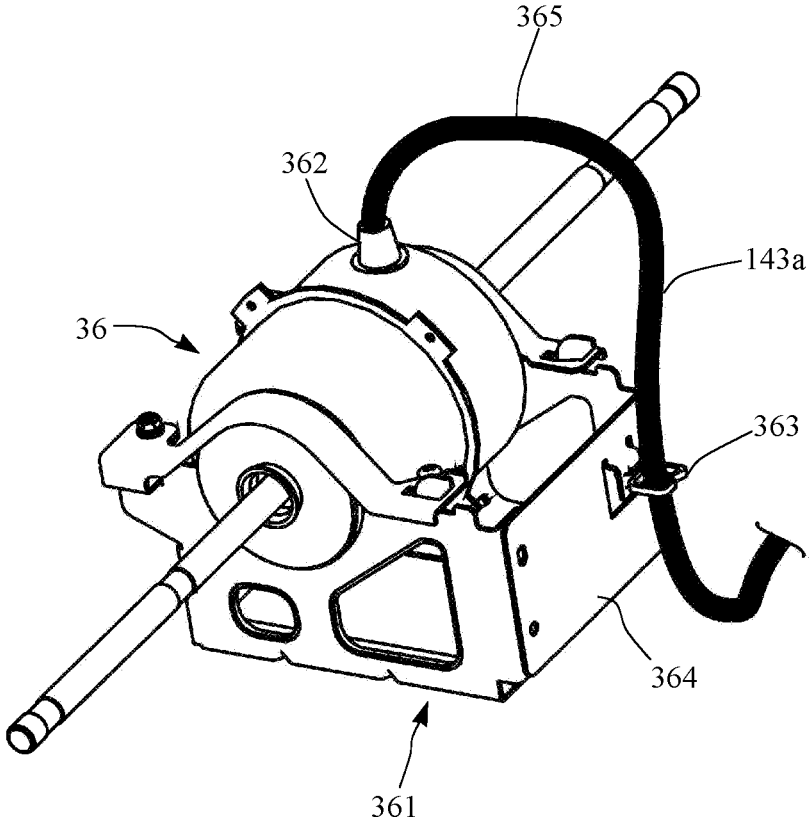
FIG. 40 is a perspective view illustrating a water trap formed in the motor lead wire of a fan motor.

During cooling operation, cold air flows in the blower chamber F, and thus dew condensation may occur on the motor lead wire 143*a*, and the condensation water may infiltrate the lead wire connecting portion 362 of the fan motor 36 illustrated in FIG. 40. To prevent such an event, the present invention takes the following measures.

As illustrated in FIG. 40, the fan motor 36 is mounted on the top panel 111 of the outer body 11 via the motor mount 361 (see FIG. 3). At this time, the lead wire connecting portion 362 is faced downward.

Although the lead wire connecting portion 362 is illustrated as facing upward in FIG. 40 for the convenience of drawing, the fan motor 36 is actually mounted on the top panel 111 of the outer body 11 via the motor mount 361 so that the lead wire connecting portion 362 faces downward, which is opposite from the top panel 111 (for example, see FIG. 3).

In this embodiment, the motor mount 361 includes a side surface portion 364 substantially perpendicular to the top panel 111 of the outer body 11 as a predetermined portion where a cable clip 363, described later, is provided. The side surface portion 364 is provided with the cable clip 363 configured to lock a portion of the motor lead wire 143*a* at a position closer to the top panel 111 than the lead wire connecting portion 362.

In this configuration, since a substantially U-shaped water trap portion 365 formed from a portion of the motor lead wire 143*a* is formed between the lead wire connecting portion 362 and the cable clip 363, even if dew condensation occurs on the motor lead wire 143*a*, the condensation water drips from the water trap portion 365 and does not infiltrate the lead wire connecting portion 362.

Note that since the bottom surface of the outer body 11 is blocked by the drain pan 40, the condensation water dripping from the water trap portion is received by the drain pan 40 and does not leak out from the outer body 11. In addition, the lead wire insertion hole 411 of the drain pan 40 is closed by a lid 412 with a sealing material after insertion of the lead wire 143*a*.

<Routing of Motor Lead Wire to Rotating Unit>

As described before, the movable blowing part 74 includes the two left and right rotating units 78 (78L, 78R). Such rotating units 78 include the vertical air vent deflector 782 as illustrated in FIG. 18 and FIG. 20, and thus the rotating unit 78 is mounted with a motor 784 configured to drive the vertical air vent deflector 782.

In other words, the rotating unit 78 includes two motors; the motor (first motor) 651 that rotates the rotating unit 78 itself, and the motor (second motor) 784 for driving the vertical air vent deflector 782.

The motor lead wire is connected to each of the first motor 651 and the second motor 784. The first motor 651 is disposed at a fixed position, while the second motor 784 moves as the rotating unit 78 reciprocally rotates in a predetermined range of angles.

Figure 41:
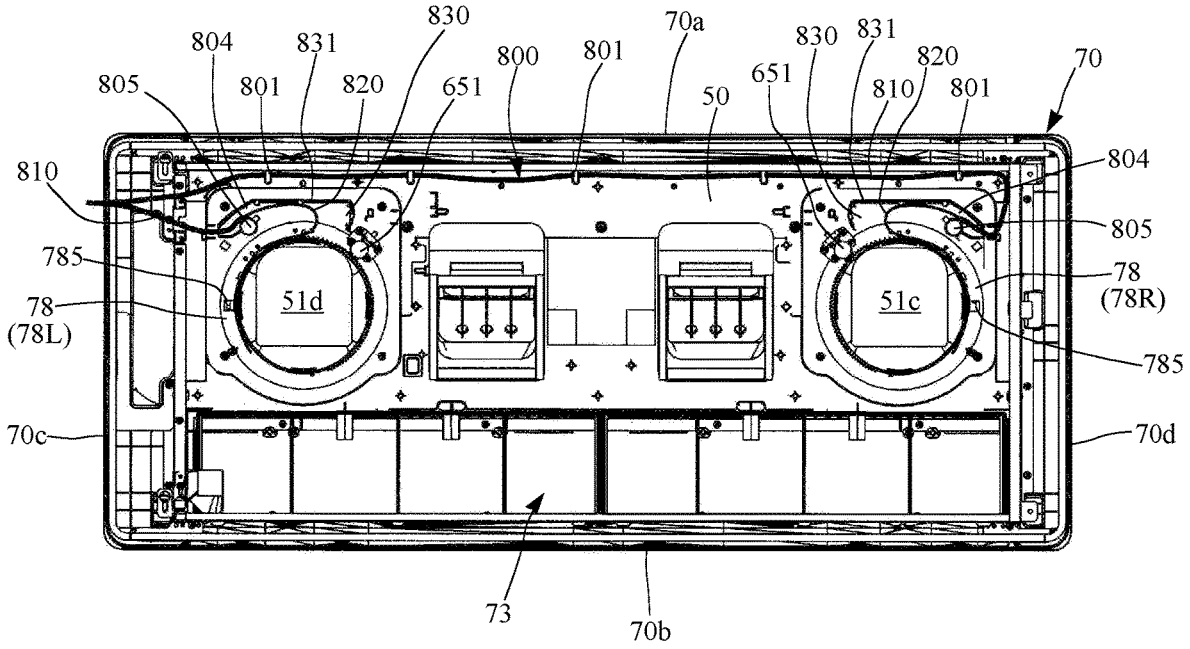
FIG. 41 is a plan view illustrating a partitioning plate unit with a motor lead wire wired to be connected to a motor for driving an air vent deflector mounted on a rotating unit.
Figure 42:
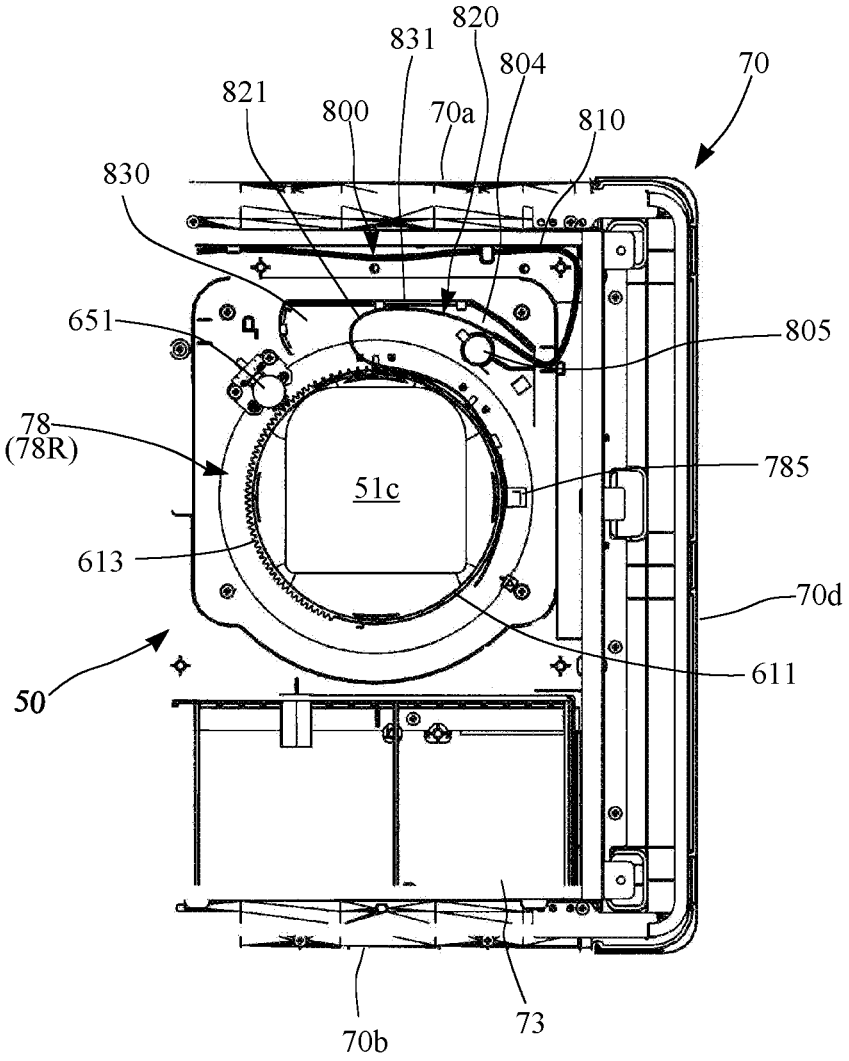
FIG. 42 is a partially enlarged plan view of FIG. 41 for explaining the motor lead wire when the rotating unit is at a first rotational position.
Figure 43:
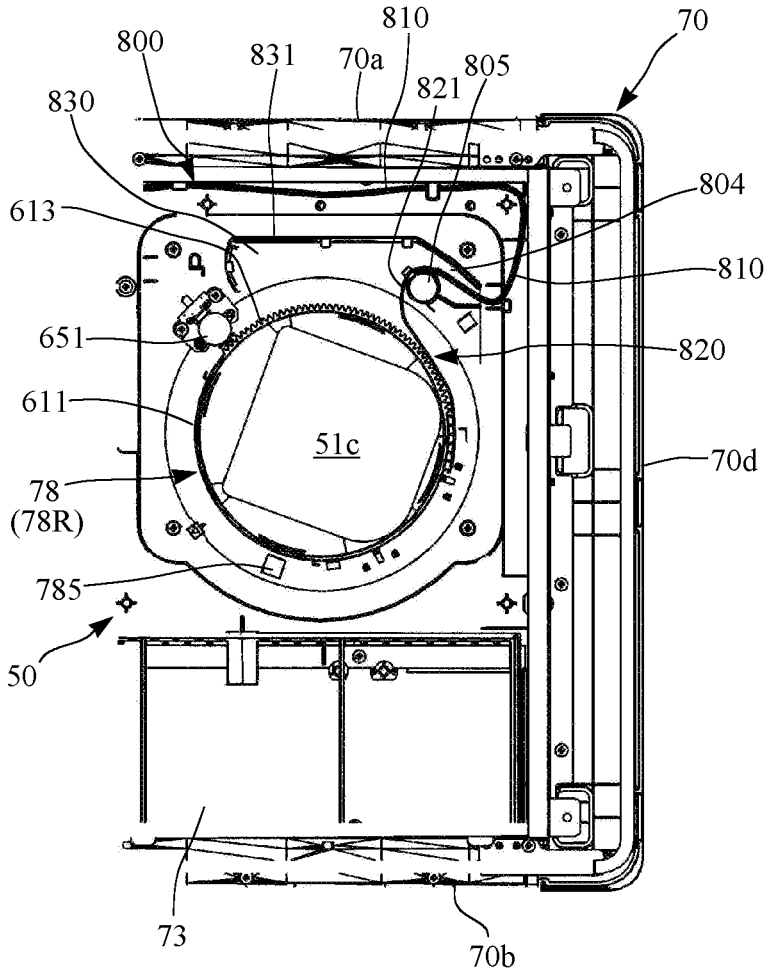
FIG. 43 is a partially enlarged plan view like FIG. 42 for explaining the motor lead wire when the rotating unit is at a second rotational position.

As the motor lead wire connected to the second motor 784 may move and repeatedly flex (bend) accordingly, the motor lead wire may disconnect or become entangled. To prevent such an event, the present invention takes the following measures. Referring now to FIG. 41 to FIG. 43, the embodiment will be described.

FIG. 41 is a plan view illustrating a partitioning plate unit 50 provided on a rear surface 70R side of the decorative panel 70, FIG. 42 is a plan view illustrating a state in which the air blowing port (second air blowing port) 783 of the right rotating unit 78R is at a first rotational position facing the front long side 70*a* side of the decorative panel 70, and FIG. 43 is a plan view illustrating a state in which the air blowing port 783 of the right rotating unit 78R is at a second rotational position facing the left short side 70*d* of the decorative panel 70.

Note that the left-side and right-side rotating units 78L, 78R have the same configuration, and thus the right rotating unit 78R will be described.

Referring now to FIG. 41, a motor lead wire 800 is wired along a predetermined inner edge of the decorative panel 70 on the rear surface 70R side, in this embodiment, the front edge of the partitioning plate unit 50 (inner edge of the decorative panel 70 on the side of the front long side 70*a*). The motor lead wire 800 is drawn from the electrical component box 14.

The motor lead wire 800 includes a lead wire for the first motor 651 and a lead wire for the second motor 784. However, illustration of the lead wire for the first motor 651 is omitted in the drawing. Note that the second motor 784 in this embodiment is also a stepper motor in the same manner as the first motor 651.

The motor lead wire 800 includes a first wiring section 810 and a second wiring section 820. The first wiring section 810 is a wiring portion wired along the front edge of the partitioning plate unit 50 and fixed by the locking member 801 of a hook shape, for example.

The motor lead wire 800 includes a plurality of flexible lead wires. In the first wiring section 810, such lead wires are covered with an insulation tube, not illustrated, while in the second wiring section 820, the above-described insulation tube is removed, and thus the flexible lead wires are exposed. The second wiring section 820 is a bendable wiring portion. Note that, in the drawing, the first wiring section 810 is depicted as a thick line, and the second wiring section 820 is depicted by a thin line.

Referring also to FIG. 42 and FIG. 43 together, the rotating unit 78R includes a connecter portion 785 for connecting the motor lead wire to the second motor 784. The bendable second wiring section 820 is drawn from the wiring drawing portion 804 into the periphery of the rotating ring 610 (see FIG. 20) of the rotating unit 78R and is connected to the connecter portion 785.

The wiring drawing portion 804 includes a cylindrical shaped boss 805 erected therefrom for bending the bendable second wiring section 820 in one direction. In this embodiment, the boss 805 is disposed at 45° in an upper right direction from the center of the rotating unit 78R, and the bendable second wiring section 820 is drawn to the periphery of the rotating unit 78R via the boss 805.

Note that as regards the left rotating unit 78L, the boss 805 is disposed at 45° in an upper left direction from the center of the rotating unit 78L as illustrated in FIG. 41, and the bendable second wiring section 820 is drawn to the periphery of the rotating unit 78L via the boss 805 in the same manner as the right rotating unit 78R.

The bendable second wiring section 820 has a length along the peripheral surface of the rotating unit 78R when the rotating unit 78R is at a second rotational position illustrated in FIG. 43. In other words, the bendable second wiring section 820 has a length extending at least from the boss 805 along the peripheral surface of the rotating unit 78R to the connecter portion 785, which is at a second rotational position.

Note that the rotating unit 78R rotates in normal use by a rotational range of 90° facing the front and the side. However, the second rotational position in FIG. 43 exceeds 90°, and actually, the rotating unit 78R is designed to be able to rotate to this extent.

The bendable second wiring section 820 has a length as described above and thus bends to form a U-shaped folded section 821 as the rotating unit 78R rotates from the second rotational position in FIG. 43 to the first rotational position in FIG. 42.

A wiring storing section 830 for the folded section 821 of the bendable second wiring section 820 is provided at a front edge side of the periphery of the rotating unit 78R of the partitioning plate unit 50. The wiring storing section 830 is provided with a guide wall 831 for moving the folded section 821 of the bendable second wiring section 820 along the direction of rotation of the rotating unit 78R.

When the rotating unit 78R rotates counterclockwise from the second rotational position toward the first rotational position, the folded section 821 moves counterclockwise in the same manner while keeping in contact with the guide wall 831, while when the rotating unit 78R rotates clockwise from the first rotational position toward the second rotational position, the folded section 821 moves clockwise in the same manner while keeping in contact with the guide wall 831.

In this configuration, since the folded section (bent section) 821 of the bendable second wiring section 820 moves as the rotating unit 78R rotates, there is no risk of disconnection of the second wiring section 820. Also, there is no risk of contact and thus entanglement of the bendable second wiring section 820 with the first wiring section 810 on the fixed side.

Figure 44:
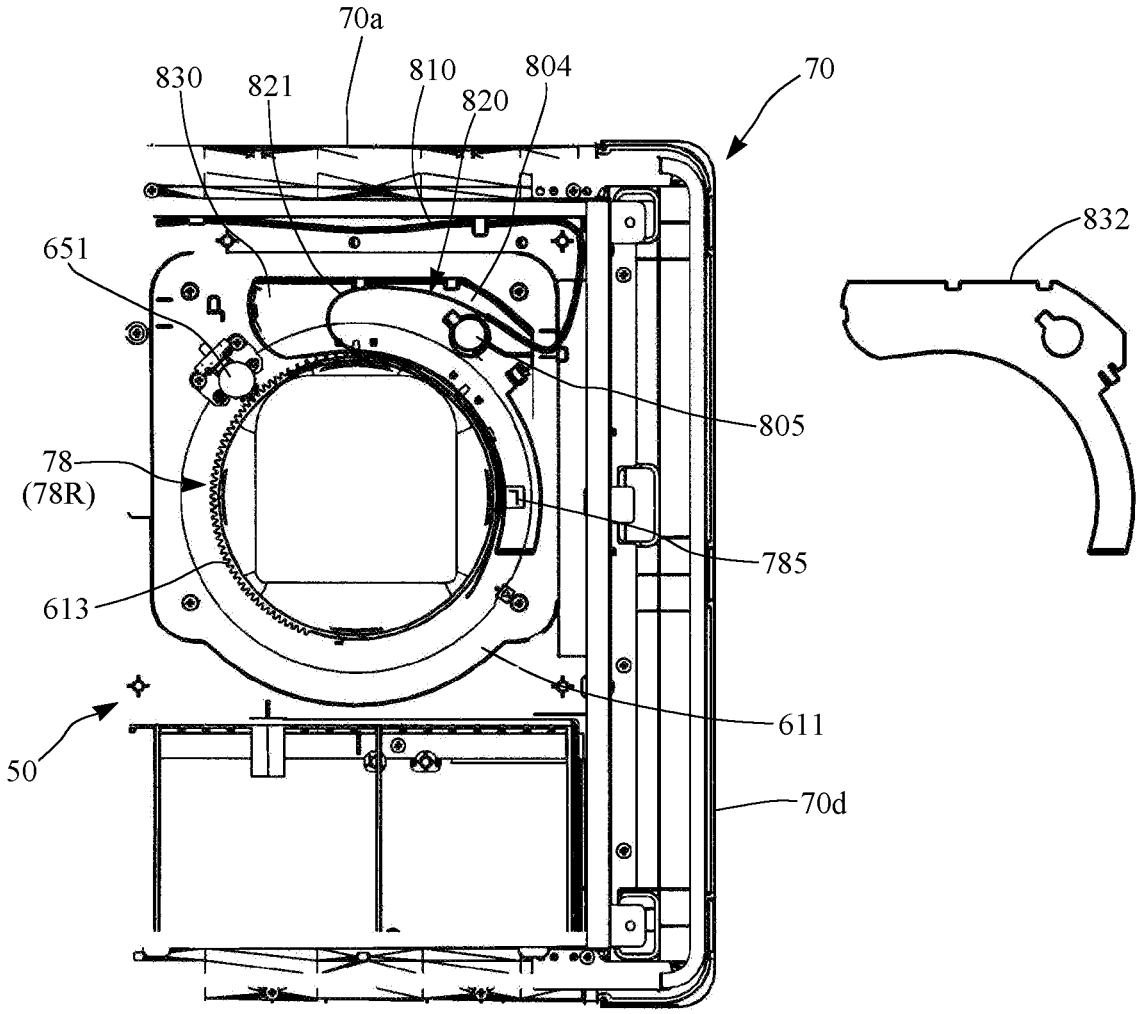
FIG. 44 is a plan view illustrating a wiring cover to be mounted on a wiring storing section.

According to this embodiment, as illustrated in FIG. 44, a wiring cover 832 is provided, which is configured to cover at least a wiring storing section 830, and preferably configured to cover a portion from the wiring storing section 830 to, for example, ¼ turn of the rotating unit 78R. This prevents the bendable second wiring section 820 from popping out or coming off.

<Assembly of Decorative Panel>

As described based on FIG. 11 to FIG. 13, the air blowing part 74 is in particular formed as a raised part 740 in which a portion of the panel part 71 is raised in a trapezoidal shape in a cross-section along the long side 70*a* toward the air-conditioning room R.

The raised part 740 is ellipsoidal, which is a rectangular shape with rounded corners including two parallel lines of equal length and two semicircles, and has a side surface (peripheral surface) forming an inclined surface, has a fixed blowing part 75 at a center portion thereof and includes movable blowing parts 77 (77L, 77R) on both left and right sides.

Figure 45:
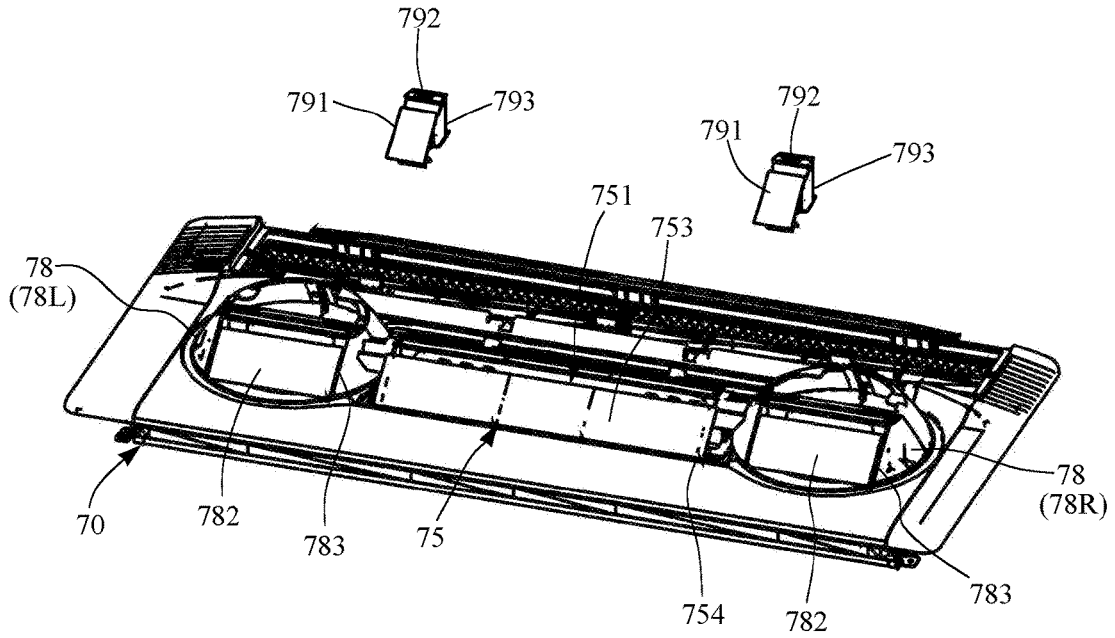
FIG. 45(*a*) (b) are perspective views illustrating a state of assembling the air blowing part to the decorative panel.
Figure 45:
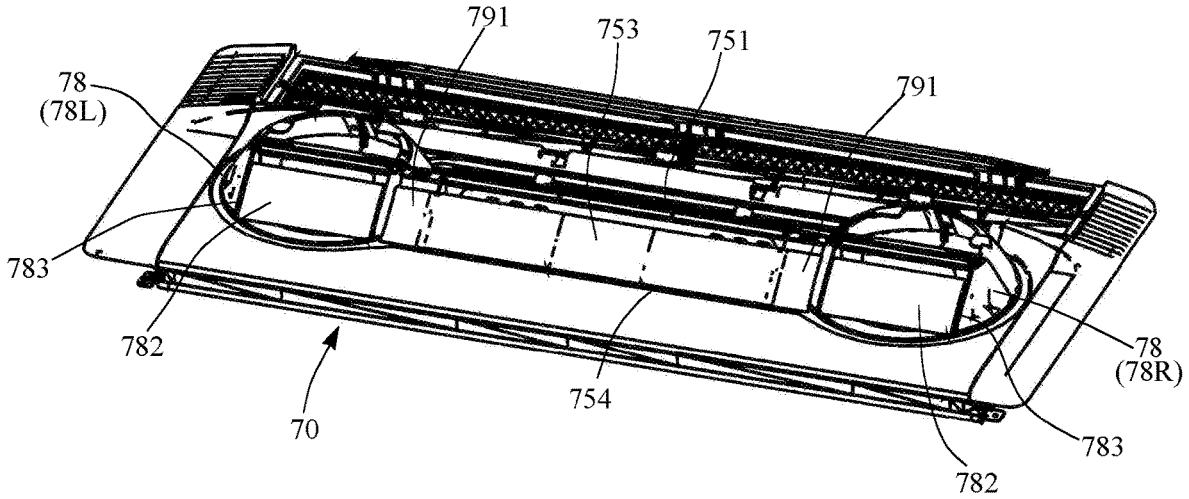

Referring to FIG. 45, to assemble the decorative panel 70, the truncated cone-shaped rotating units 78 (78L, 78R) constituting the movable blowing part 77 (77L, 77R) are disposed on both sides of the raised part 740, and a central blowing unit 751 is disposed therebetween as the fixed blowing part 75 as illustrated in FIG. 15.

Dummy flaps 791 are disposed between the left rotating unit 78L and the central blowing unit 751, and between the right rotating unit 78R and the central blowing unit 751 to give an appearance that the first air blowing port 754 and the second air blowing port 783 are continuous, respectively. The rotating unit 78, the central blowing unit 751, and the dummy flaps 791 may be fixed to the partitioning plate unit 50 provided on the rear surface 70R side of the decorative panel 70 by claws or screws, or the like.

Although not illustrated, a motor for driving the vertical air vent deflector 753 is mounted on a side surface of the central blowing unit 751. The dummy flaps 791 each have a mounting leg 793 for the partitioning plate unit 50 on the back surface side thereof.

At an upper edge of the central blowing unit 751 in FIG. 45 (the lower edge when viewed from the air-conditioning room R side), a plurality of locking holes (not illustrated) for locking the cover panel 900 of the fixed blowing part 75 described later is formed. Also, the dummy flaps 791 each include a locking hole 792 for locking the above-described cover panel 900 formed on a flat upper surface thereof.

Figure 46:
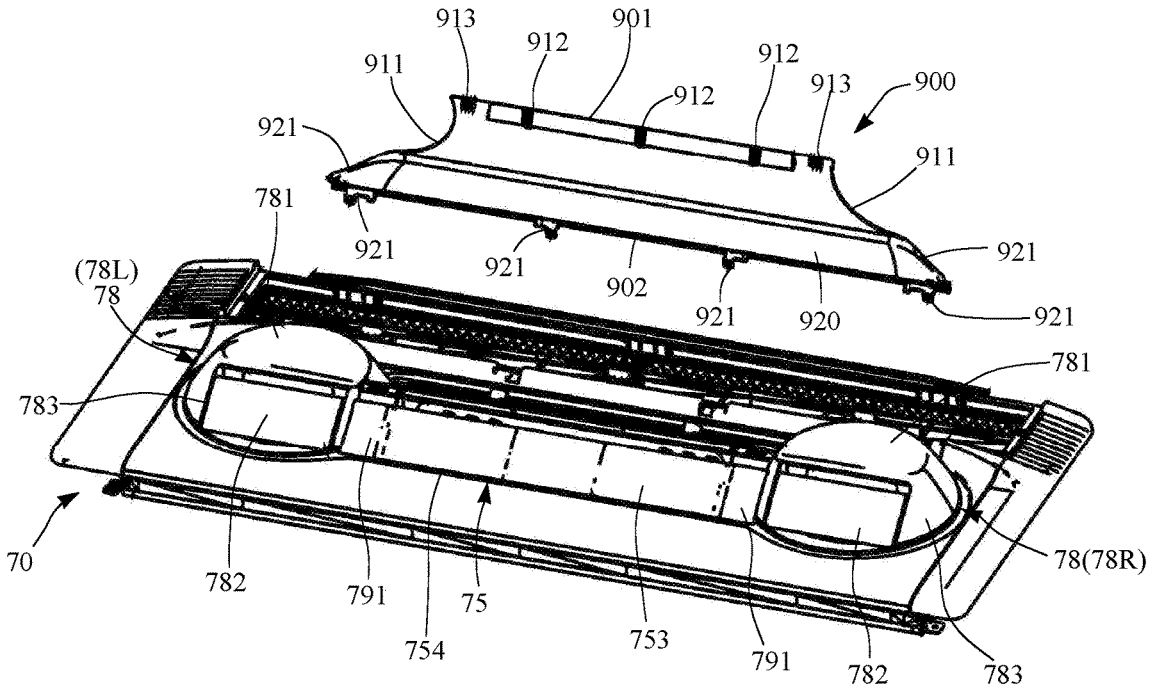
FIG. 46(*a*) (b) are perspective views viewing the state of mounting a cover panel on a fixed blowing part of the air blowing part viewed from the front.
Figure 46:
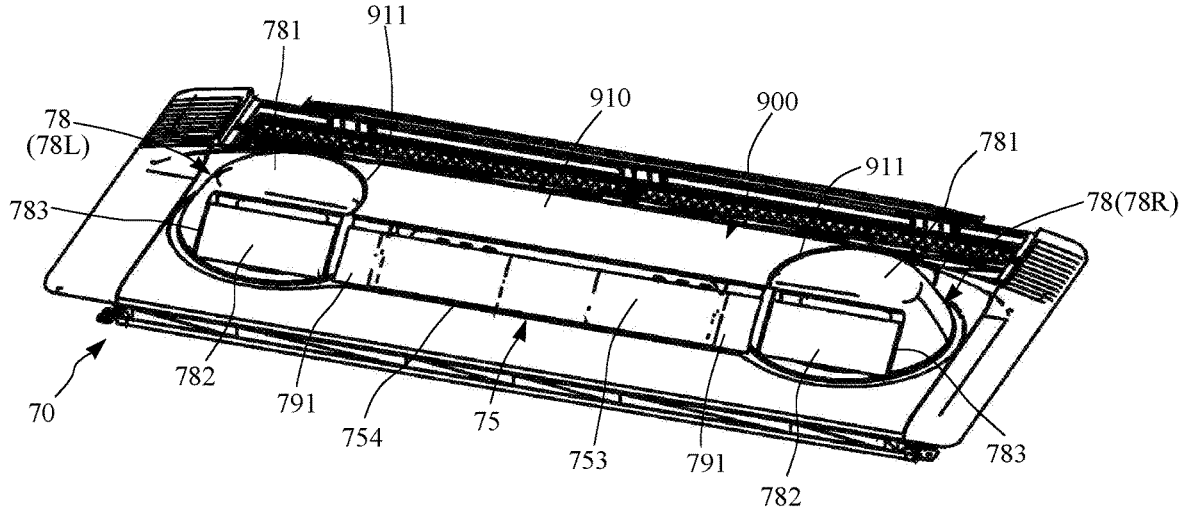
Figure 47:
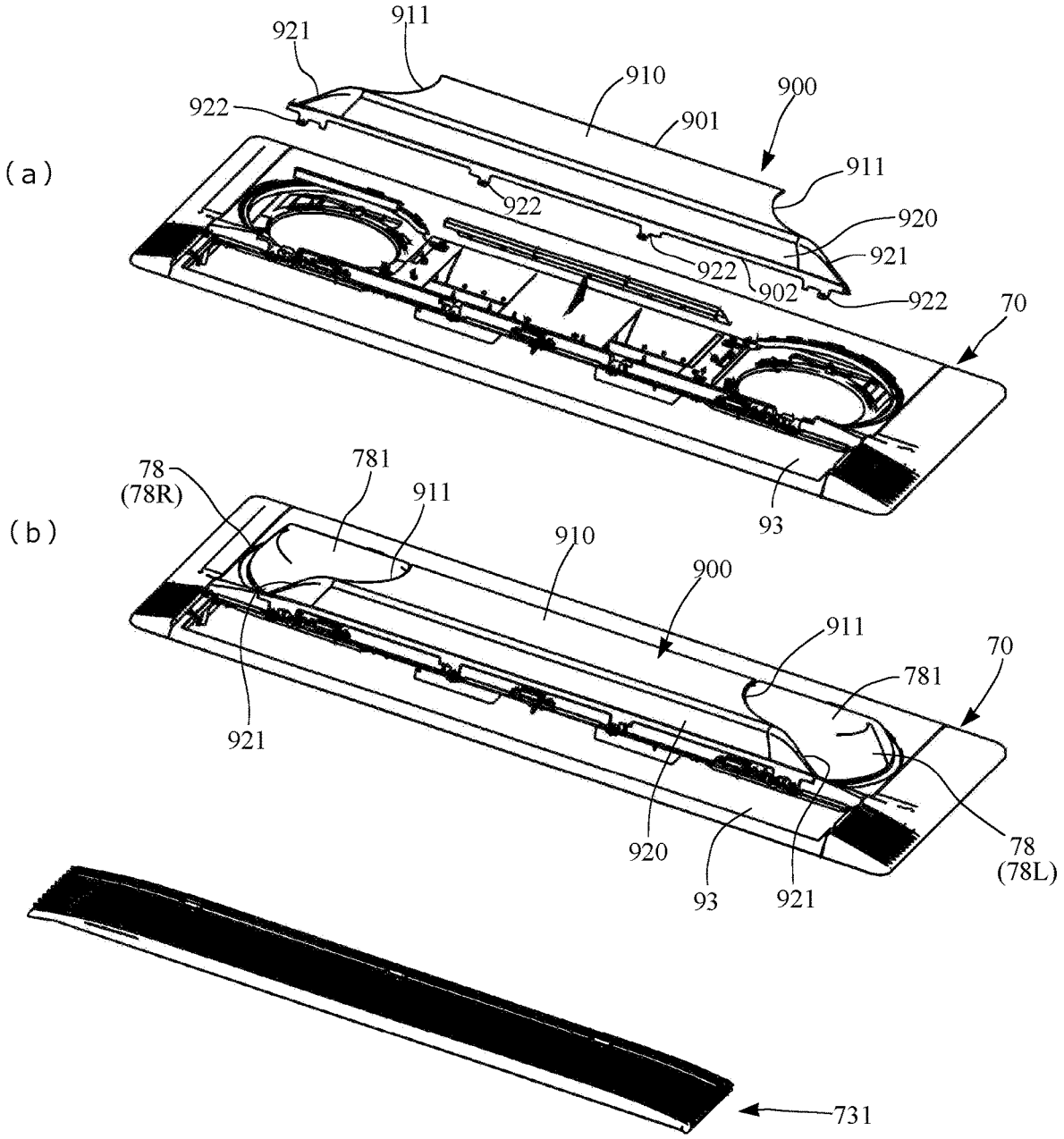
FIG. 47(*a*) (b) are perspective views of the above-described cover panel viewed from the rear.

Referring to FIG. 46 and FIG. 47, the fixed blowing part 75 includes a cover panel 900 disposed between the rotating units 78L, 78R. The cover panel 900 integrally includes a main panel part 910 and a rear panel part 920.

Note that FIG. 46 is a perspective view of the decorative panel 70 viewed from the front, and FIG. 47 is a perspective view of the decorative panel 70 viewed from the rear. In FIG. 47, an illustration of the rotating unit 78, the central blowing unit 751, and the dummy flaps 791 is omitted.

The main panel part 910 has a flat surface having the same height as the top surface 781 of the rotating units 78L, 78R covering a lower part of the fixed blowing part 75 (lower part when viewed from the air-conditioning room R, upper part in FIG. 46). The rear panel part 920 is formed between the main panel part 910 and the air suction part 73 to cover the back surface side of the fixed blowing part 75 integrally with the main panel part 910.

At both ends of the main panel part 910, arcuate portions 911 that match portions of edges of the top surfaces 781 of the rotating units 78L, 78R are formed. At both ends of the rear panel part 920, hem portions 921 are formed along conical surfaces of the rotating units 78L, 78R.

The arcuate portions 911 of the main panel part 910 and the hem portions 921 of the rear panel part 920 are formed continuously, and portions of the rotating units 78L, 78R are covered by the arcuate portions 910 and the hem portions 921.

As illustrated in FIG. 46(*a*), the front end edge 901 of the main panel part 910 includes locking claws (first locking claws) 912 for the above-described locking holes of the central blowing unit 751 and locking claws (second locking claws) 913 for locking holes 792 of the dummy flaps 791 formed thereon. Note that the shape (configuration) of these locking claws 912, 913 are omitted from the illustration for the convenience of drawing, and only the locations are illustrated by black squares.

Also, as illustrated in FIG. 46(*a*), screw retaining pieces 922 to be screwed to the interior of the air suction part 73 are provided at a plurality of (four in this example) locations on a rear end edge 902 of the rear panel part 920.

In this configuration, the first locking claws 912 of the main panel part 910 are locked in the locking holes 755 of the central blowing unit 751, and the second locking claws 913 of the main panel part 910 are locked in the locking holes 792 of the dummy flaps 791, and then the screw retaining pieces 922 of the rear panel part 920 are screwed to predetermined portions in the air suction part 73 so that the screwing locations (mounting parts) or the like of the fixed blowing part 75, the movable blowing part 77, and the dummy flaps 791 to the partitioning plate unit 50 can be hidden by the cover panel 900.

Also, since the screw retaining pieces 922 of the rear panel part 920 are blindfolded by the suction grill 731 mounted on the air suction part 73, the design is not compromised.

<Prevention of Water Dripping from Air Blowing Port>

During cooling operation, cold air is blown out from the air blowing port (first air blowing port) 754 of the fixed blowing part 75 and the air blowing port (second air blowing port) 783 of the rotating unit 78 as the movable blowing part 77, and thus water droplets due to dew condensation adhere to the peripheries of the air blowing ports 754, 783, which cause water dripping when grown.

In the present invention, water dripping due to dew condensation is prevented without compromising the design of the decorative panel 70, but rather with improved design.

As a basic configuration, surface texturing (also referred to as emboss processing) is applied to a panel surface 70S around the air blowing ports 754, 783. However, the surface texture is not a fine satin surface texture, but a coarse dot-patterned surface texture (dotted surface texture) in the present invention.

Figure 48:
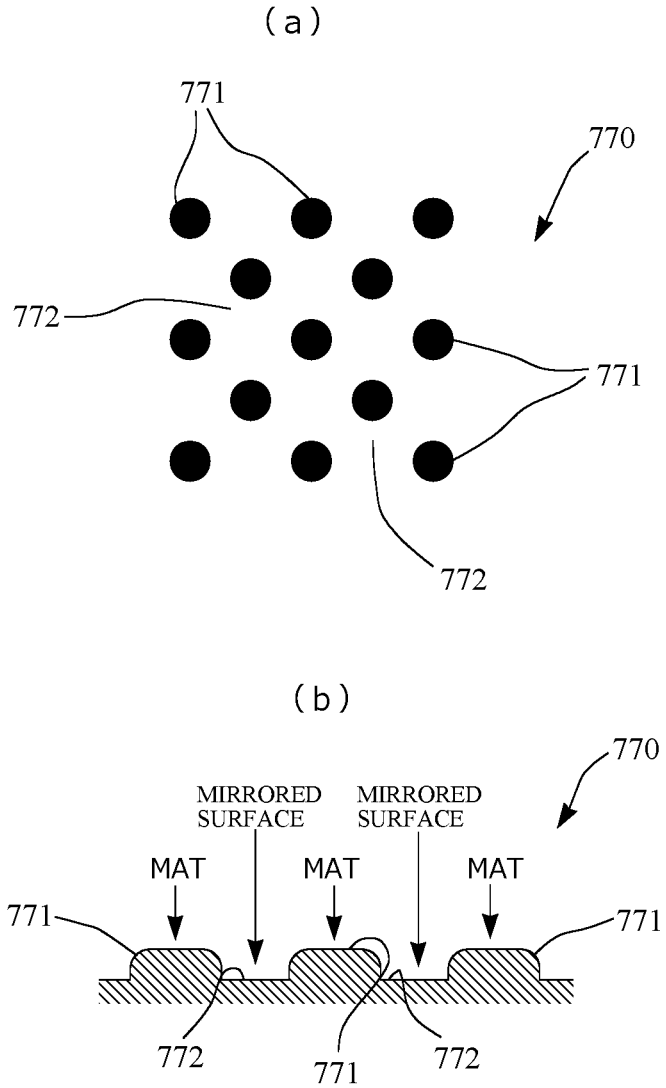
FIG. 48(*a*) is a partially enlarged plan view of dotted surface texture used for preventing water dripping and (b) is a cross-sectional view of the same.

Referring to FIG. 48(*a*) and FIG. 48(*b*), the dotted surface texture 700 includes a number of projections 771, and the intervals of the adjacent projections 771, 771 are set to be wider than the normal satin surface texture having fine recesses and projections. Accordingly, the dew condensation generated on the panel surface 70S is accelerated to flow along the panel surface 70S, which prevents the dew condensation from growing and causing water dripping from.

Note that the surface texture includes a number of recesses and projections, but the recesses and projections are intended to mean relative shapes. Therefore, in the description in this specification, the recesses 772 refer to portions between the projections 771, that is, the portions other than the projections 771.

As a preferable aspect, the projections 771 have a cylindrical shape, having a diameter of 1.0 mm, and the intervals between the adjacent projections 771, 771 may be in a range from 1.0 to 3.0 mm (especially 2.0 mm), and the height of the projections 771 may preferably be 50 μm.

To improve the appearance quality with a high design function, preferably, only top surfaces of the projections 771 are matted to make them rough surfaces, and the recesses 772 other than the projections 771 have glossy finishing (mirrored surfaces). This creates a sense of luxury.

Figure 49:
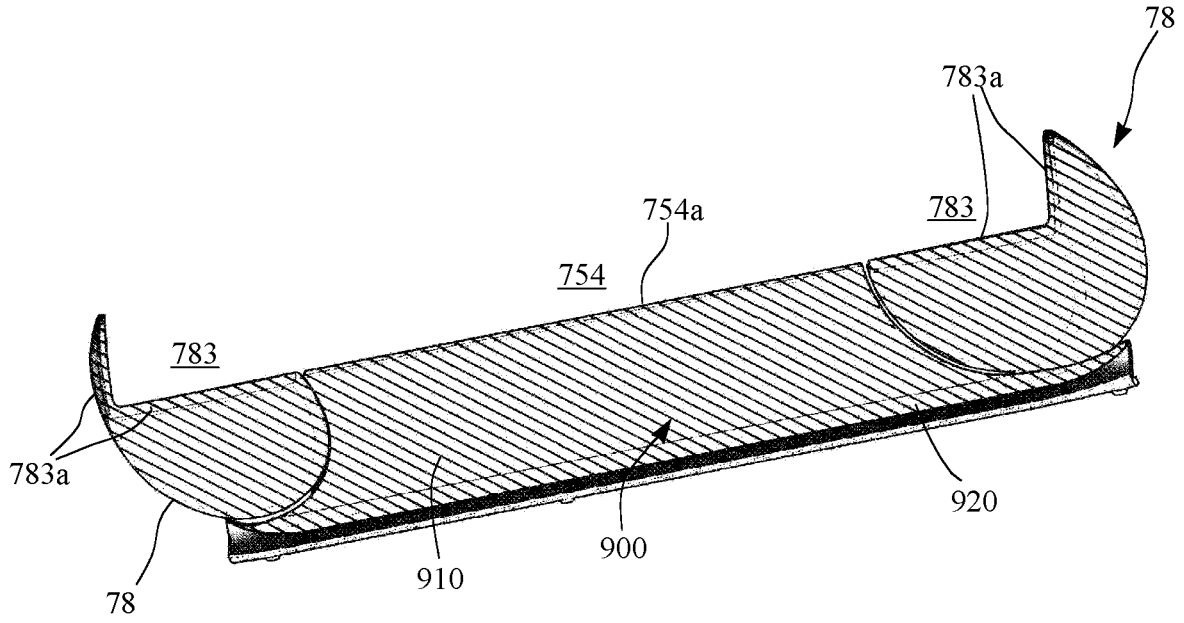
FIG. 49 is a perspective view illustrating a portion of the air blowing part where the dotted surface texture is provided.

In addition, as illustrated in FIG. 49, the dotted surface texture 700 is preferably formed not only on edges 754*a*, 783*a* around the air blowing ports 754, 783, but also on the entire surface of the raised part 740 of the air blowing part 74 (the hatched part in FIG. 49), that is, the surface of the truncated cone of the rotating unit 78 and the surface of the cover panel 900. This provides an advantage that defects (sink marks or the like) caused by the molding process become less noticeable.

REFERENCE SIGNS LIST

1: Indoor unit
10: body unit
11: outer body
111: top panel
112, 113: side plate
12: mounting bracket
13: heat insulating material
14: electrical component box

15: cable storage part
16: lid member
17: opening window
18*a*: suspending member
18*b*: hook
19: opening
20: heat exchanger
20L: front heat exchanger section
20R: rear heat exchanger section
21: coupling plate
30: fan unit
31: blower fan
32: impeller
33: airflow path
34: fan casing
343: air-blowing section
35: rotating shaft
36: fan motor
361: motor mount
362: lead wire connecting portion
363: clip
371: lower casing
372: upper casing
373: motor mount
40: drain pan
411: lead wire insertion hole
43: ventilation hole
45: flume section
50: partitioning plate unit
51 (51*a*-51*d*): duct
520: opening
521: inner flange
523: stable seat
600: drive means
610: rotating ring
611: cylindrical part
612: vent hole
613: rack teeth
614: outer flange
616: protrusion
618: sealing material
630: duct cover
633: inner bottom surface
635: guide groove
70: decorative panel
70*a*, 70*b*: long side
70*c*, 70*d*: short side
71: panel part
71*a*: panel main body
71*b*: side panel
711: wall
712: slope surface
72: side wall portion
721, 760: frame
722, 765, 766: beam
73: air suction part
74: air blowing part
740: raised part
75; fixed blowing part
751: central blowing unit
754: first air blowing port
77 (77L, 77R): movable blowing part
78 (78L, 78R): rotating unit
782: vertical air vent deflector
784: motor for driving vertical air vent deflector
785: connecter portion
783: second air blowing port
770: dotted surface texture
771: projection
772: recess
800: motor lead wire for motor for driving vertical air vent deflector
804: wiring drawing portion
805: boss
810: fixed first wiring section
820: bendable second wiring section
830: wiring storing section
831: guide wall
832: wiring cover
900: cover panel
910: main panel part
920: rear panel part
R: air-conditioning room
T1: ceiling
T2: attic
F: blower chamber
S1, S2: air suction chamber
L: air conduction path
TS: room temperature sensor

The invention claimed is:

1. An air conditioner comprising:
a box-type body unit disposed in an attic of an air-conditioning room; and
a decorative panel mounted on a bottom surface of the body unit along a ceiling surface of the air-conditioning room, the decorative panel being provided with an air suction part and an air blowing part,
wherein the air blowing part includes a fixed blowing part and truncated conical-shaped rotating units disposed on both sides thereof, and a raised part protruding toward the air-conditioning room side more than a panel surface of the decorative panel, and a cover panel of the fixed blowing part and the truncated conical-shaped rotating units are provided with dotted surface texture including a plurality of projections.

2. The air conditioner according to claim 1, wherein recesses between the projections are finished into a mirrored surface, and top surfaces of the projections are rougher surfaces than those of the recesses.

3. The air conditioner according to claim 1, wherein the plurality of projections have a cylindrical shape and are disposed at intervals of 1.0 to 3.0 mm.

4. The air conditioner according to claim 1, wherein the projections have a diameter of 1.0 mm and a height of 50 μm.

5. The air conditioner according to claim 1,
wherein the projections are disposed at intervals which allows condensation water adhered to the panel surface of the decorative panel to flow along the panel surface.

6. The air conditioner according to claim 5, wherein recesses between the projections are finished into a mirrored surface, and top surfaces of the projections are rougher surfaces than those of the recesses.

7. The air conditioner according to claim 5, wherein the plurality of projections have a cylindrical shape and are disposed at intervals of 1.0 to 3.0 mm.

8. An air conditioner comprising:
a box-type body unit; and
a decorative panel,
wherein a dotted surface texture including a plurality of projections is formed along a panel opening that forms an air blowing port in the decorative panel, and the projections are disposed at intervals which allows condensation water adhered to a panel surface of the decorative panel to flow along the panel surface, wherein the box-type body unit is disposed in an attic of an air-conditioning room, wherein the decorative panel is mounted on a bottom surface of the body unit along a ceiling surface of the air-conditioning room, the decorative panel being provided with an air suction part and an air blowing part, and wherein the air blowing part includes a fixed blowing part and truncated conical-shaped rotating units disposed on both sides thereof, and a raised part protruding toward the air-conditioning room side more than the panel surface of the decorative panel, and a cover panel of the fixed blowing part and the truncated conical-shaped rotating units are provided with dotted surface texture including the plurality of projections.

9. The air conditioner according to claim 8, wherein recesses between the projections are finished into a mirrored surface, and top surfaces of the projections are rougher surfaces than those of the recesses.

10. The air conditioner according to claim 8, wherein the plurality of projections have a cylindrical shape and are disposed at intervals of 1.0 to 3.0 mm.

11. The air conditioner according to claim 8, wherein the projections have a diameter of 1.0 mm and a height of 50 μm.

12. The air conditioner according to claim 9, wherein the plurality of projections have a cylindrical shape.

13. The air conditioner according to claim 9, wherein the projections have a diameter of 1.0 mm and a height of 50 μm.

14. The air conditioner according to claim 10, wherein the projections have a diameter of 1.0 mm and a height of 50 μm.

15. The air conditioner according to claim 8, wherein the plurality of projections have a cylindrical shape.

* * * * *